US008899781B2

(12) United States Patent
Kim et al.

(10) Patent No.: US 8,899,781 B2
(45) Date of Patent: Dec. 2, 2014

(54) LIGHTING DEVICE

(71) Applicant: LG Innotek Co., Ltd., Seoul (KR)

(72) Inventors: Kwang Soo Kim, Seoul (KR); Kyung Il Kong, Seoul (KR); Hwayoung Kim, Seoul (KR); Sang Jun Hong, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 0 days.

(21) Appl. No.: 14/016,680

(22) Filed: Sep. 3, 2013

(65) Prior Publication Data

US 2014/0003028 A1 Jan. 2, 2014

Related U.S. Application Data

(63) Continuation of application No. 12/805,796, filed on Aug. 19, 2010, now Pat. No. 8,534,865.

(30) Foreign Application Priority Data

| | | |
|---|---|---|
| Aug. 19, 2009 | (KR) | 10-2009-0076953 |
| Mar. 30, 2010 | (KR) | 10-2010-0028854 |
| Mar. 30, 2010 | (KR) | 10-2010-0028855 |
| Mar. 30, 2010 | (KR) | 10-2010-0028856 |
| Mar. 30, 2010 | (KR) | 10-2010-0028857 |
| Mar. 30, 2010 | (KR) | 10-2010-0028858 |
| Mar. 30, 2010 | (KR) | 10-2010-0028859 |
| Apr. 5, 2010 | (KR) | 10-2010-0030716 |

(51) Int. Cl.
*F21S 4/00* (2006.01)
*F21V 17/16* (2006.01)

(Continued)

(52) U.S. Cl.
CPC ..... *F21V 7/00* (2013.01); *F21V 17/162* (2013.01); *F21S 8/026* (2013.01); *F21Y 2103/003* (2013.01); *F21V 19/004* (2013.01); *F21V 7/0008* (2013.01); *F21V 13/08* (2013.01); *F21V 23/0442* (2013.01); *F21Y 2101/02* (2013.01)
USPC ..... 362/225; 362/217.06; 362/240

(58) Field of Classification Search
USPC ..... 362/225, 235, 240, 241, 247, 217.06, 362/249.02
See application file for complete search history.

(56) References Cited

U.S. PATENT DOCUMENTS

| | | | |
|---|---|---|---|
| 3,857,029 | A | 12/1974 | Krinke |
| 4,748,543 | A | 5/1988 | Swarens |

(Continued)

FOREIGN PATENT DOCUMENTS

| | | |
|---|---|---|
| CN | 1762061 | 4/2006 |
| CN | 2918977 | 7/2007 |

(Continued)

OTHER PUBLICATIONS

United States Office Action dated Nov. 18, 2011 issued in U.S. Appl. No. 12/805,796.

(Continued)

*Primary Examiner* — Peggy Neils
(74) *Attorney, Agent, or Firm* — Ked & Associates, LLP

(57) ABSTRACT

A lighting device comprises a housing; a coupling member coupled to the housing, comprising a first outer surface and a second outer surface, and having an insertion recess disposed between the first outer surface and the second outer surface; a first reflector disposed between the first outer surface of the coupling member and the housing; a second reflector disposed between the second outer surface of coupling member and the housing; and a light source unit comprising a first body and a second body, wherein the first body comprises a first coupling unit coupled to a first inner surface of the insertion recess and a first light emitting device emitting lights to the first reflector, wherein the second body comprises a second coupling unit coupled to a second inner surface of the insertion recess and a second light emitting device emitting lights to the second reflector.

19 Claims, 28 Drawing Sheets

(51) Int. Cl.

| | |
|---|---|
| ***F21S 8/02*** | (2006.01) |
| ***F21V 19/00*** | (2006.01) |
| ***F21V 13/08*** | (2006.01) |
| *F21Y 103/00* | (2006.01) |
| *F21V 7/00* | (2006.01) |
| *F21V 23/04* | (2006.01) |
| *F21Y 101/02* | (2006.01) |

(56) References Cited

U.S. PATENT DOCUMENTS

| | | | | |
|---|---|---|---|---|
| 5,199,782 | A | 4/1993 | Johnson et al. | |
| 7,261,435 | B2 | 8/2007 | Gould et al. | |
| 7,413,323 | B2 | 8/2008 | Lippis et al. | |
| 7,520,636 | B2 | 4/2009 | Van Der Poel | |
| 7,559,672 | B1 | 7/2009 | Parkyn et al. | 362/244 |
| 7,591,578 | B2 | 9/2009 | Chang | |
| 7,654,702 | B1 | 2/2010 | Ding et al. | |
| 7,686,470 | B2 | 3/2010 | Chiang | |
| 7,824,056 | B2 | 11/2010 | Madireddi et al. | |
| 7,986,078 | B2 | 7/2011 | Horiguchi et al. | |
| 8,013,537 | B2 | 9/2011 | Summerland | |
| 8,038,314 | B2 | 10/2011 | Ladewig | |
| 8,038,327 | B1 | 10/2011 | Franck et al. | |
| 8,057,061 | B2 | 11/2011 | Otsuki et al. | |
| 8,061,867 | B2 | 11/2011 | Kim et al. | |
| 8,104,920 | B2 | 1/2012 | Dubord | |
| 8,113,680 | B2 | 2/2012 | O'Brien et al. | |
| 8,128,256 | B2 | 3/2012 | Kim et al. | |
| 8,398,276 | B2 * | 3/2013 | Pearson et al. | 362/432 |
| 8,534,865 | B2 * | 9/2013 | Kim et al. | 362/225 |
| 2003/0016536 | A1 | 1/2003 | Lin | |
| 2004/0085770 | A1 | 5/2004 | Tyler et al. | |
| 2005/0265019 | A1 | 12/2005 | Sommers et al. | |
| 2005/0281023 | A1 | 12/2005 | Gould et al. | |
| 2005/0281030 | A1 | 12/2005 | Leong et al. | |
| 2007/0064425 | A1 | 3/2007 | Frecska et al. | |
| 2008/0037239 | A1 | 2/2008 | Thomas et al. | |
| 2010/0008090 | A1 | 1/2010 | Li et al. | |
| 2010/0232155 | A1 | 9/2010 | Wang | 362/235 |
| 2010/0284181 | A1 | 11/2010 | O'Brien et al. | |
| 2010/0315813 | A1 | 12/2010 | Fugerer et al. | |

FOREIGN PATENT DOCUMENTS

| | | | |
|---|---|---|---|
| CN | 101463960 | | 6/2009 |
| DE | 27 37 766 | | 3/1978 |
| DE | 10 2005 053304 | | 4/2008 |
| EP | 0 539 621 | | 5/1993 |
| GB | 2 442 013 | A | 3/2008 |
| JP | 06-275116 | A | 9/1994 |
| JP | 2002-042523 | A | 2/2002 |
| JP | 2003-092006 | A | 3/2003 |
| JP | 2005-285767 | A | 10/2005 |
| JP | 2006-088881 | A | 4/2006 |
| JP | 2007-080533 | A | 3/2007 |
| JP | 2008-515140 | A | 5/2008 |
| JP | 2008-218129 | | 9/2008 |
| JP | 2009-516330 | | 4/2009 |
| JP | 2010-044956 | A | 2/2010 |
| KR | 10-2005-0121650 | A | 12/2005 |
| KR | 10-2006-0036039 | A | 4/2006 |
| KR | 10-2007-0004326 | A | 1/2007 |
| KR | 10-2008-0012091 | A | 2/2008 |
| KR | 10-2008-0077160 | A | 8/2008 |
| KR | 10-2008-0113722 | A | 12/2008 |
| KR | 10-0883346 | B1 | 2/2009 |
| KR | 10-0931266 | B1 | 12/2009 |
| KR | 20-2010-0001603 | A | 2/2010 |

OTHER PUBLICATIONS

United States Final Office Action dated Apr. 11, 2012 issued in U.S. Appl. No. 12/805,796.

United States Office Action dated Oct. 2, 2012 issued in U.S. Appl. No. 12/805,796.

United States Final Office Action dated Mar. 11, 2013 issued in U.S. Appl. No. 12/805,796.

Chinese Office Action issued in related Application No. 201010520982.9 dated Jan. 13, 2014.

Partial European Search Report issued in related Application No. 10173430.9 dated Jan. 27, 2014.

Partial European Search Report issued in related Application No. 10173422.6 dated Jan. 30, 2014.

Japanese Office Action issued in related Application No. 2010-184365 dated Apr. 22, 2014.

Japanese Office Action issued in related Application No. 2010-184370 dated Apr. 22, 2014.

European Search Report issued in Application No. 10173430.9 dated Jun. 24, 2014.

* cited by examiner

LIGHTING DEVICE

CROSS-REFERENCE TO RELATED APPLICATION

This application is a Continuation application of U.S. application Ser. No. 12/805,796 filed Aug. 19, 2010, which claims priority from Korean Application No. 10-2009-0076953, filed Aug. 19, 2009, No. 10-2010-0030716, filed Apr. 5, 2010, No. 10-2010-0028854, filed Mar. 30, 2010, No. 10-2010-0028855, filed Mar. 30, 2010, No. 10-2010-0028856, filed Mar. 30, 2010, No. 10-2010-0028857, filed Mar. 30, 2010, No. 10-2010-0028858, filed Mar. 30, 2010, No. 10-2010-0028859, filed Mar. 30, 2010, the subject matters of which are incorporated herein by reference.

BACKGROUND

1. Field

Embodiments may relate to a lighting device.

2. Background

A light emitting diode (LED) is a semiconductor element for converting electric energy into light. As compared with existing light sources such as a fluorescent lamp and an incandescent electric lamp and so on, the LED has advantages of low power consumption, a semi-permanent span of life, a rapid response speed, safety and an environment-friendliness. For this reason, many researches are devoted to substitution of the existing light sources with the LED. The LED is now increasingly used as a light source for lighting devices, for example, various lamps used interiorly and exteriorly, a liquid crystal display device, an electric sign and a street lamp and the like.

SUMMARY

One embodiment is a lighting device. The lighting device comprises a housing; a coupling member coupled to the housing, comprising a first outer surface and a second outer surface, and having an insertion recess disposed between the first outer surface and the second outer surface; a first reflector disposed between the first outer surface of the coupling member and the housing; a second reflector disposed between the second outer surface of coupling member and the housing; and a light source unit comprising a first body and a second body, wherein the first body comprises a first coupling unit coupled to a first inner surface of the insertion recess and a first light emitting device emitting lights to the first reflector, wherein the second body comprises a second coupling unit coupled to a second inner surface of the insertion recess and a second light emitting device emitting lights to the second reflector.

Another embodiment is a lighting device. The lighting device comprises a housing; a coupling member coupled to the housing and having an insertion recess; a light source unit comprising: a first body coupled to the insertion recess of the coupling member; a second body coupled to the insertion recess of the coupling member; and a elastic member disposed between the first body and the second body and providing a force pushing outward upper portions of the first body and the second body; and a coupling cap coupled to one ends of the first body and the second body, and comprising a first and a second axis protrusions and a first and a second deterrent protrusions, wherein the first body is coupled to the first axis protrusion and the first deterrent protrusion, and wherein the second body is coupled to the second axis protrusion and the second deterrent protrusion.

Further another embodiment is a lighting device. The lighting device comprises a housing including an upper surface and a inner wall surface; a coupling member coupled to the upper surface of the housing; a reflector disposed between the coupling member and the inner wall surface of the housing; a light source unit coupled to the coupling member and having a light emitting recess disposed in a light emitting device, wherein the reflector is disposed on the light emitting recess, wherein the light source unit comprises a projection part disposed around the light emitting recess, and wherein the projection part is on a straight line passing through the light emitting device and an end of the housing.

BRIEF DESCRIPTION OF THE DRAWINGS

Arrangements and embodiments may be described in detail with reference to the following drawings in which like reference numerals refer to like elements and wherein.

DETAILED DESCRIPTION

Hereinafter, embodiments of the present invention will be described in detail with reference to accompanying drawings. However, the accompanied drawings are provided only for more easily describing the embodiments. It is easily understood by those skilled in the art that the spirit and scope of the present invention is not limited to the scope of the accompanied drawings.

Embodiment 1

Figure 1:
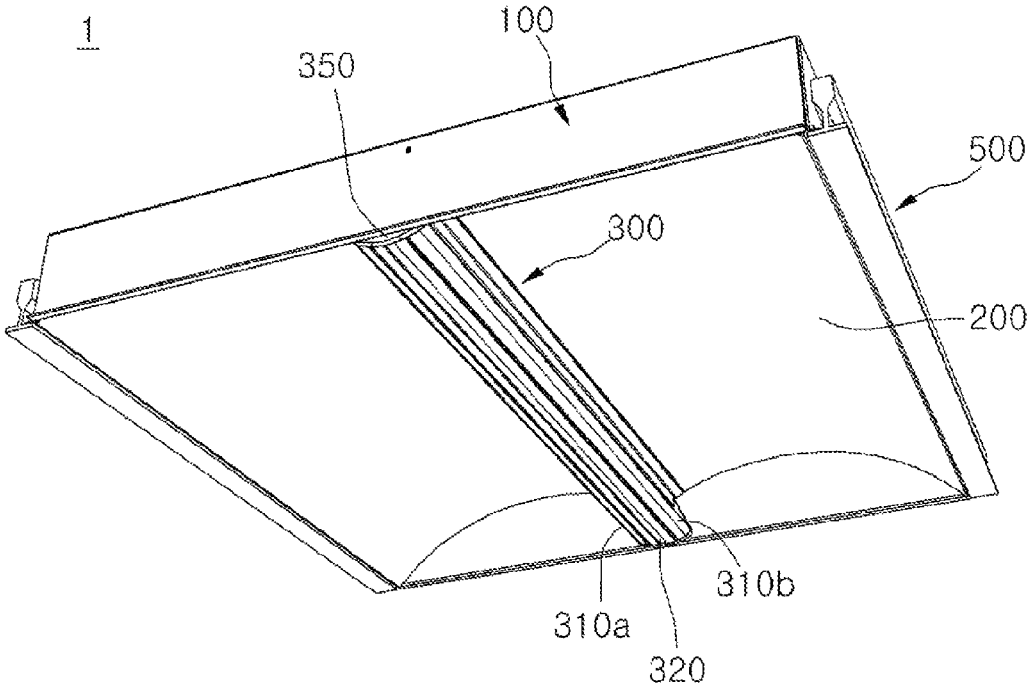
FIG. 1 is a perspective view of a light device in accordance with an embodiment 1 of the present invention.
Figure 2:
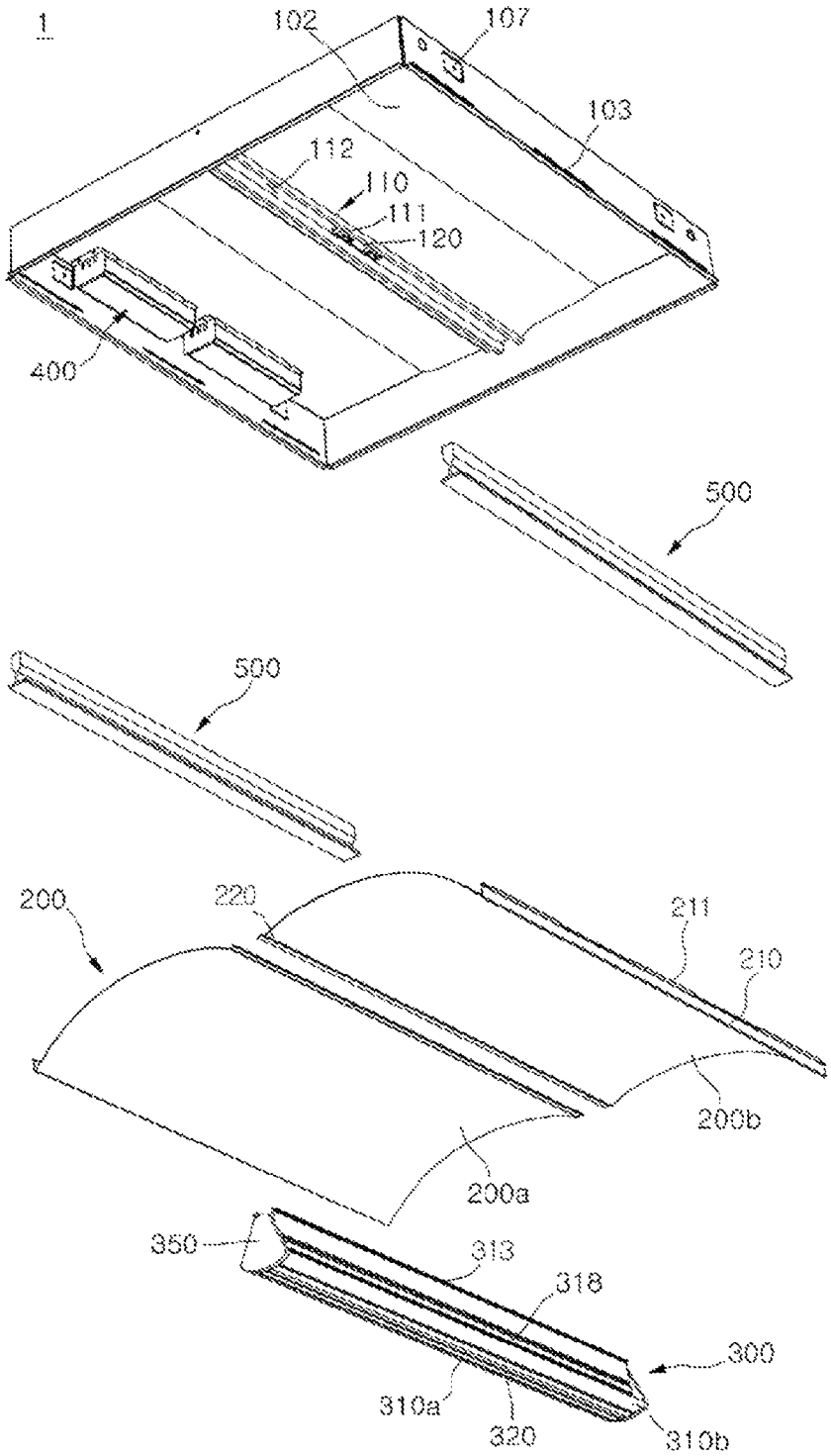
FIG. 2 is an exploded perspective view of a light device in accordance with the embodiment 1 of the present invention.
Figure 3:
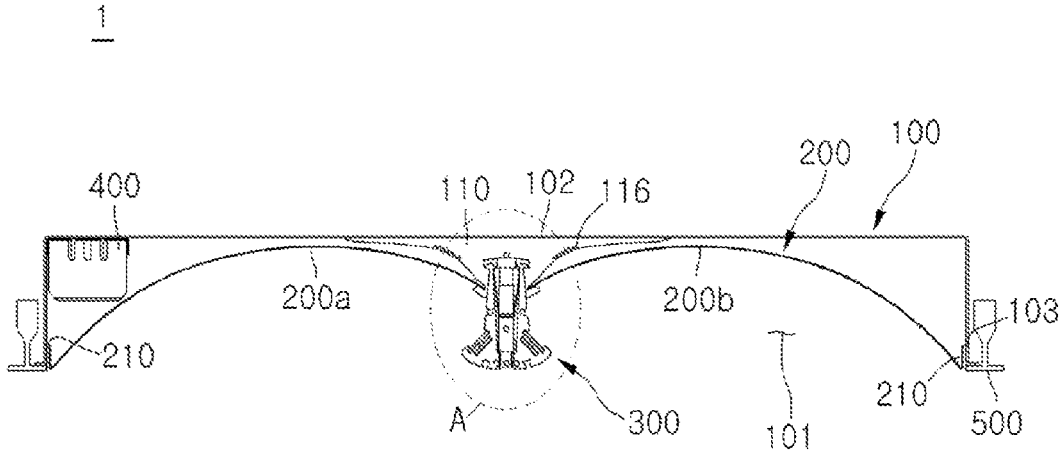
FIG. 3 is a cross sectional view of a light device in accordance with the embodiment 1 of the present invention.
Figure 4A:
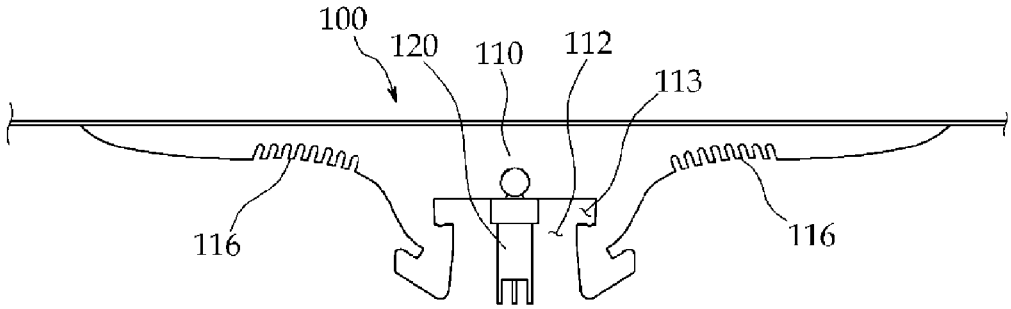
FIG. 4*a* is a cross sectional view of a coupling member shown in FIG. 3.
Figure 4B:
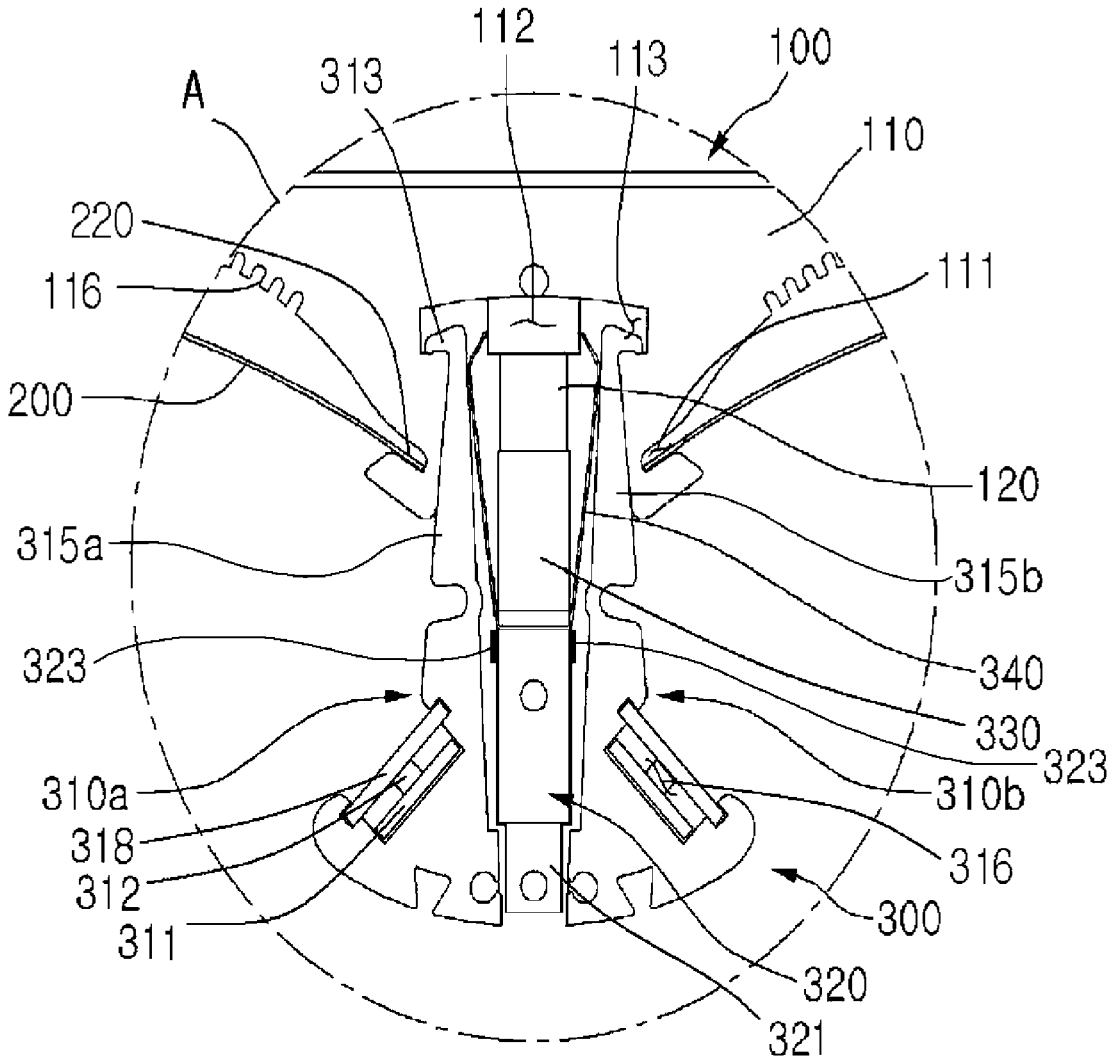
FIG. 4*b* is a view showing an enlarged part denoted by "A" of FIG. 3.
Figure 4C:
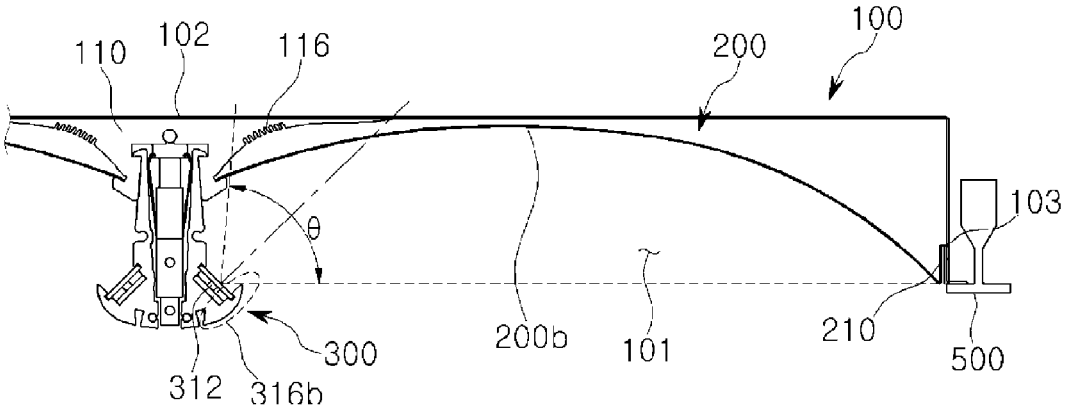
FIG. 4*c* is a view showing a light distribution angle of a light emitting diode mounted in the light emitting recess according to the embodiment 1 of the present invention.

FIG. 1 is a perspective view of a light device 1 in accordance with an embodiment 1 of the present invention. FIG. 2 is an exploded perspective view of a light device 1 in accordance with the embodiment 1 of the present invention. FIG. 3 is a cross sectional view of the light device in accordance with the embodiment 1 of the present invention. FIG. 4*a* is a cross sectional view of a coupling member shown in FIG. 3. FIG. 4*b* is a view showing an enlarged part denoted by "A" of FIG. 3. FIG. 4*c* is a view showing a light distribution angle θ of a light emitting diode 312 mounted in the light emitting recess (or groove) 316 according to the embodiment 1 of the present invention. In the present disclosure the terms recess and groove are used interchangeably.

In FIGS. 1 to 4*c*, a lighting device 1 in accordance with an embodiment 1 of the present invention includes a housing 100, a coupling member 110, a reflector 200, a light source unit 300 and a power supply unit 400.

Housing 100 and Coupling Member 110

The housing 100 has a shape of a box for accepting the housing 100, the coupling member 110, the reflector 200 and the power supply unit 400. While the shape of the housing 100 as viewed from the outside is quadrangular, the housing 100 can have various shapes without being limited to this.

The housing 100 is made of a material capable of efficiently releasing heat. For example, the housing 100 is made of a metallic material such as Al, Sn, Ni, Ag, Cu, Ti, Mo, W, Au and Pt and so on. The housing 100 may be also made of various resin materials.

A connecting recess 107 for connecting electrically the power supply unit 400 to an external power supply is formed on a lateral surface and/or an upper surface of the housing 100.

The housing 100 includes an opening 101 such that light radiated from the light source unit 300 is reflected to be emitted by the reflector 200.

Meanwhile, in order to dispose the lighting device 1 on an external support member such as a ceiling or a wall surface, an insertion unit corresponding to a shape of the lighting device 1 is formed in the external support member, and then the lighting device 1 is inserted into and fixed to the insertion unit. Here, a coupling frame 500 is coupled to the lower part of the lateral surface of the housing 100, so that the lighting device 1 can be securely coupled to the external support member.

The coupling member 110 is coupled on an inner upper surface of the housing 100. The coupling member 110 is coupled to the housing 100 by using various methods. For example, the coupling member 110 is coupled to the housing 100 by means of a coupling screw, an adhesive agent and so on.

The coupling member 110 is formed to be extended on an upper surface 102 of the housing 100 in a first direction. For example, the coupling member 110 can be extended from an inner wall surface to the opposite inner wall surface of the housing 100.

The housing 100 and the coupling member 110 are attachable to and removable form the reflector 200.

A second recess 103 is formed on the inner wall surface of the housing 100. A first side 210 of the reflector 200 is inserted into the second recess 103. It is possible to form the one second recess 103 or a plurality of the second recesses 103.

A first recess 111 is formed on an outer wall surface of the coupling member 110. The first recess 111 is formed to be extended in the first direction. A second side 220 of the reflector 200 is inserted into the first recess 111.

The housing 100 and the coupling member 110 can fix and sustain the reflector 200 by inserting the first side 210 of the reflector 200 into the second recess 103 of the housing 100 and by inserting the second side 220 of the reflector 200 into the first recess 111 of the coupling member 110.

In addition, the light source unit 300 is attachable to and removable from the coupling member 110.

An insertion recess 112 is formed in the middle part of the coupling member 110. A part of the light source unit 300 is inserted into the insertion recess 112. The insertion recess 112 can be formed to be extended in the first direction.

A third recess 113 is formed on an inner wall surface of the insertion recess 112. A projection 313 of the light source unit 300 is inserted into the third recess 113. As a result, the light source unit 300 is securely coupled to the coupling member 110 by means of the third recess 113. The coupling of the light source unit 300 and the coupling member 110 will be described later in more detail.

A first connection terminal 120 is formed in the middle part within the insertion recess 112. When the light source unit 300 is inserted into the insertion recess 112, the first connection terminal is coupled to and electrically connected to a second connection terminal 330 of the light source unit 300. When the first connection terminal 120 is connected to the second connection terminal 330, electric power and/or a driving signal can be transferred to the light source unit 300 through the first connection terminal 120 and the second connection terminal 330.

Based on a design of the light source device 1, it is possible to form the one first connection terminal 120 or a plurality of the first connection terminals 120. More detailed descriptions of the first connection terminal 120 and the second connection terminal 330 will be provided later.

The coupling member 110 performs a function of directly releasing heat generated from the light source unit 300 or transferring the heat to the housing 100.

It is desirable to form the coupling member 110 by using a material capable of efficiently releasing and/or transferring the heat. For example, the coupling member 110 is made of a metallic material such as Al, Sn, Ni, Ag, Cu, Ti, Mo, W, Au and Pt and so on.

A part of the coupling member 110 can have an uneven structure 116. The uneven structure 116 can widen the surface area of the coupling member 110 and improve a heat release effect.

Reflector 200

The reflector 200 includes a first reflector 200*a* and a second reflector 200*b*. The first reflector 200*a* and the second reflector 200*b* are attachable to and removable from the housing 100 and the coupling member 110.

For example, as shown in FIG. 2, the second reflector 200*b* is coupled to the housing 100 and the coupling member 110 by inserting the second side 220 of the second reflector 200*b* into the first recess 111 of the coupling member 110 and by inserting the first side 210 of the second reflector 200*b* into the second recess 103 of the housing 100. The second side 220 of the reflector 200 can have a level difference. The first side 210 of the reflector 200 can also have a level difference. At least one insertion end 211 which is inserted into the second recess 103 is formed at the first side 210 of the reflector 200. A shape of the second recess 103 is formed to correspond to the selection end 211.

The first reflector 200*a* and the second reflector 200*b* have a parabola-shaped surface and are extended in the first direction. Therefore, the first reflector 200*a* and the second reflector 200*b* have a parabolic shape having two parabolic surfaces. Here, the shape of the reflector 200 can be variously changed according to a desired lighting.

The reflector 200 is made of a metallic material or a resin material which has a high reflection efficiency. For example, the resin material includes any one of PET, PC and PVC resin. The metallic material includes any one of Ag, alloy including Ag, Al, and alloy including Al.

The surface of the reflector 200 is coated with Ag, Al, white photo solder resist (PSR) ink, a diffusion sheet and the like. Otherwise, an oxide film is formed on the surface of the reflector 200 by an anodizing process.

Here, the material and color of the reflector 200 are not limited and are variously selected depending on a lighting generated by the lighting device 1.

Power Supply Unit 400

When the power supply unit 400 is connected to the light source unit 300, the power supply unit 400 can supply at least one of electric power and a driving signal.

As shown in FIGS. 2 and 3, the power supply unit 400 is disposed in a space between the parabola-shaped reflector 200 and the inner surface of the housing 100. That is, due to the parabola shape of the reflector 200, an empty space is formed between the reflector 200 and a corner inside the housing 100. As a result, the power supply unit 400 is disposed in the empty space.

The power supply unit 400 converts an alternating current (AC) electric power into a direct current (DC) electric power and outputs the direct current (DC) electric power.

The power supply unit 400 is electrically connected to the light source unit 300 through a wire or a flexible printed circuit board (FPCB). For example, a wire or a FPCB is extended from the power supply unit 400 and is electrically connected to the first connection terminal 120 through the connecting recess 107 formed in the coupling member 110. The first connection terminal 120 is electrically connected to the second connection terminal 330. As a result, the power supply unit 400 is electrically connected to the light source unit 300.

Light Source Unit 300

Figure 5:
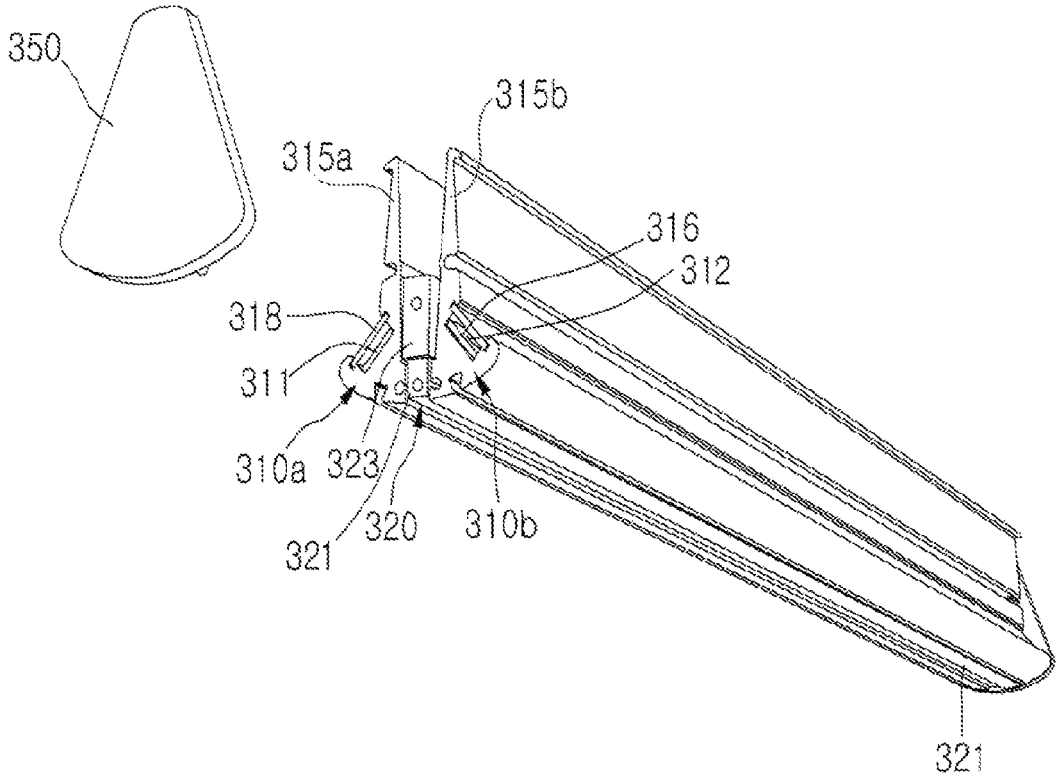
FIGS. 5 and 6 are perspective views of a light source unit in accordance with the embodiment 1 of the present invention.
Figure 6:
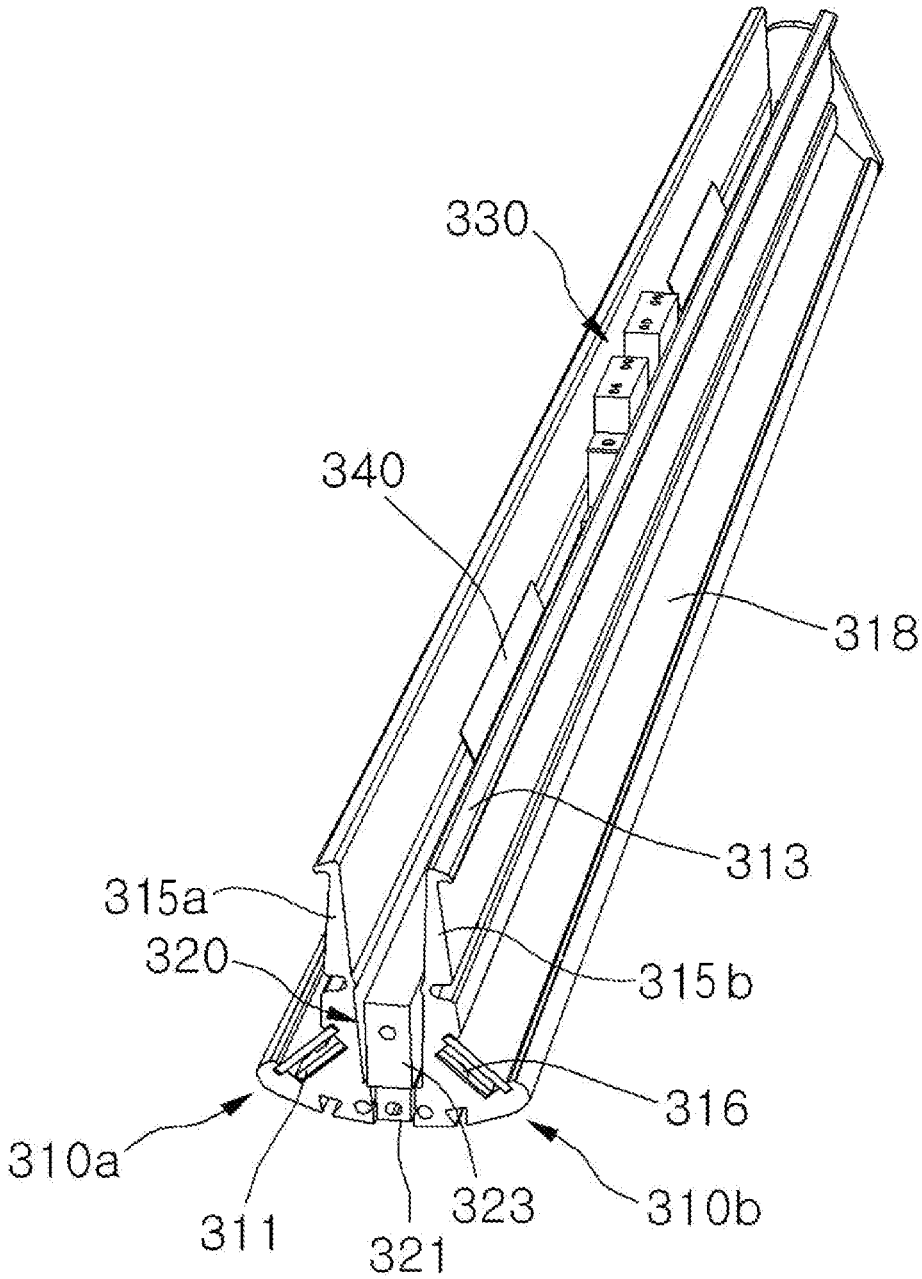
Figure 7:
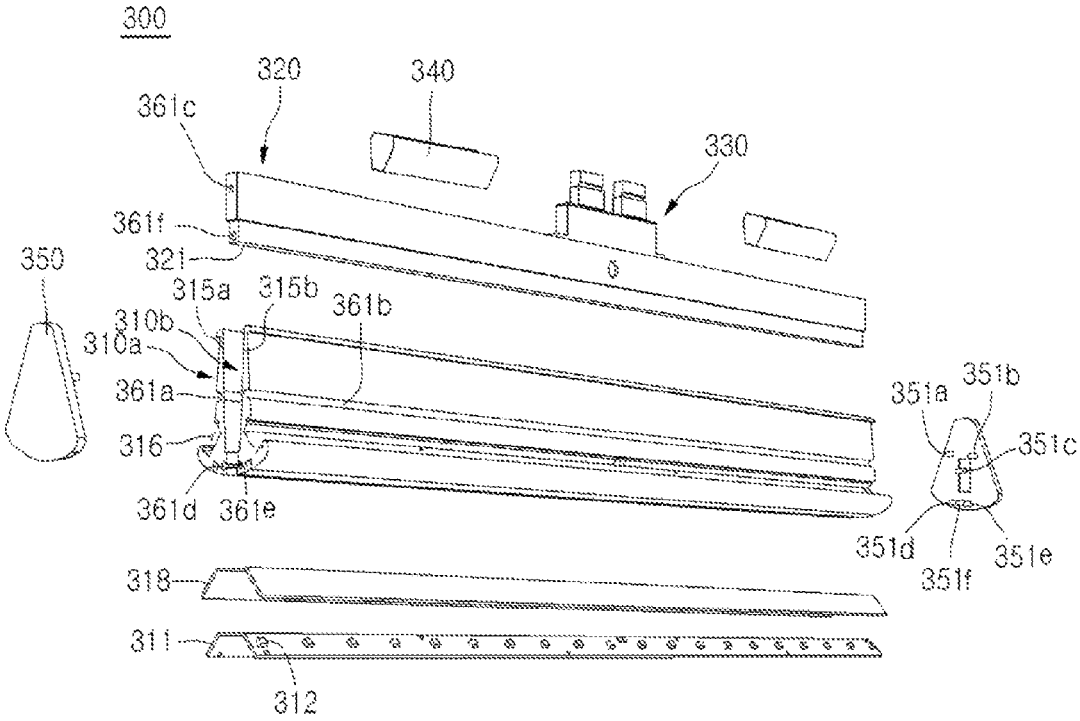
FIG. 7 is an exploded perspective view of a light source unit in accordance with the embodiment 1 of the present invention.

FIG. 4*b* is a view showing an enlarged part denoted by "A" of FIG. 3. FIGS. 5 and 6 are perspective views of a light source unit 300 in accordance with an embodiment 1 of the present invention. FIG. 7 is an exploded perspective view of a light source unit 300 in accordance with an embodiment 1 of the present invention.

In FIGS. 4 to 7, the light source unit 300 in accordance with an embodiment 1 of the present invention includes a first body 310*a*, a second body 310*b*, a middle body 320, a plurality of light emitting diodes (LED) 312 and a coupling cap 350. The first body, the second body 310*b* and the middle body 320 form a body of the light source unit 300. The light source unit 300 may be formed to be extended in the first direction, that is, in the direction of length of the reflector 200.

First Body 310*a* and Second Body 310*b*

The lower part of the first body 310*a* is formed to have a first sloping surface. The first sloping surface is formed on the outer wall surface of the first body 310*a*. The first sloping surface is formed such that the first sloping surface faces the parabolic surface of the first reflector 200*a*. Here, a plurality of the sloping surfaces as well as the first sloping surface can be formed in the first body 310*a*.

The lower part of the second body 310*b* is also formed to have a second sloping surface. The second sloping surface is formed on the outer wall surface of the second body 310*b*. The second sloping surface is formed such that the second sloping surface faces the parabolic surface of the second reflector 200*b*. Here, a plurality of the sloping surfaces as well as the second sloping surface can be formed in the second body 310*b*.

A light emitting recess 316 is formed on the first and the second sloping surfaces respectively.

A substrate 311 is provided on the basal surface of the light emitting recess 316. A plurality of the light emitting diodes 312 may be provided on the substrate 311. Otherwise, a plurality of electrodes (not shown) are disposed in the light emitting recesses 316 so that a plurality of the electrodes (not shown) is electrically connected to a plurality of the light emitting diodes 312. An optical structure 318 is formed on a plurality of the light emitting diodes 312. The optical structure 318 will be described later.

The depth and width of the light emitting recess 316 can be variously adjusted according to the light distribution of a plurality of the light emitting diodes 312 disposed inside the light emitting recess 316. In other words, the lighting device 1 is able to cause the reflector 200 to provide users with light radiated from the light source unit 300 by adjusting the depth and width of the light emitting recess 316 instead of directly providing users with light radiated from the light source unit 300. As a result, it is possible to provide users with subdued light by reducing glare.

A light distribution angle of light emitted from the light emitting recess 316 is from 90° to 110°. The depth and width of the light emitting recess 316 is formed to cause light emitted from the light emitting recess 316 to be incident evenly on the entire area of the reflector 200.

Additionally, the depth and width of the light emitting recess 316 is adjusted such that a part of light radiated from a plurality of the light emitting diodes 312 is radiated to the outside through the opening 101 and the rest of the light is reflected by the reflector 200 and is radiated to the outside through the opening 101.

A plurality of the light emitting diodes 312 are determined, for example, through various combinations of red, green, blue and white light emitting diode which radiate red, green, blue and white light respectively. A plurality of the light emitting diodes 312 can be disposed in the light emitting recess 316 in the form of an array.

A plurality of the light emitting diodes 312 are controlled by electric power and/or a driving signal which are provided by the power supply unit 400, causing a plurality of the light emitting diodes 312 to selectively emit light or to adjust the luminance of light.

The optical structure 318 is disposed on a plurality of the light emitting diodes 312. The optical structure 318 functions to adjust the light distribution and the color sense of light radiated from a plurality of the light emitting diodes 312, and creates emotional lighting having various luminance and color senses if necessary.

The optical structure 318 is coupled to the light source unit 300 by inserting in a sliding way both ends of the optical structure 318 into a fourth recess formed on an inner surface of the light emitting recess 316. For example, the fourth recess is extended in the first direction and the optical structure 318 is coupled to the light source unit 300 by being inserted into the fourth recess in the first direction.

The optical structure 318 includes at least one of a lens, a diffusion sheet and a phosphor luminescent film (PLF).

The lens includes various lenses such as a concave lens, a convex lens and a condensing lens and so on according to a design of the lighting device 1.

The diffusion sheet diffuses evenly light radiated from a plurality of the light emitting diodes 312.

The phosphor luminescent film (PLF) includes fluorescent substance. Since the fluorescent substance included in the phosphor luminescent film (PLF) is excited by light radiated from a plurality of the light emitting diodes 312, the lighting device 1 can produce emotional lighting having various color senses by mixing a first light radiated from a plurality of the light emitting diodes 312 and a second light excited by the fluorescent substance.

For example, when a plurality of the light emitting diodes 312 radiate blue light and the phosphor luminescent film (PLF) includes a yellow fluorescent substance excited by blue light, the lighting device 1 radiates white light by mixing the blue light and yellow light.

The optical structure 318 is easily coupled to the fourth recess. Accordingly, a lens, a diffusion sheet and a phosphor luminescent film (PLF) can be alternately used as the optical structure 318.

Generally, the light distribution angle of the light emitted from the light emitting diode is about 120°. When the light emitting diode emits the light having such a wide light distribution angle, a part of the emitted light is reflected by the reflector 200 and is emitted to the outside through the opening 101. However, the rest of the light is directly emitted through the opening 101 to the outside, thereby enabling a user to feel glare.

To overcome such a problem, the light emitting recess 316 may be formed to block the light emitted directly from the light emitting diode 312 to the outside of the housing 100. That is, the light emitting recess 316 includes a projection part 316*b* formed on the basal surface thereof, thereby blocking the light emitted directly from the light emitting diode 312 to the outside of the housing 100.

As a result, due to the projection part 316*b* of the light emitting recess 316, the light emitted from a plurality of the light emitting diodes 312 is not directly provided to a user and is uniformly incident on the whole area of the reflector 200. Accordingly, it is possible to provide users with subdued light by reducing glare.

Furthermore, it is possible to block the direct light emitted from the light emitting diode 312 to the outside of the housing 100 by adjusting the depth and width of the light emitting recess 316, the height of the projection part 316*b*, the sloping angle of the basal surface 316*a*, the height of the housing 100 or the width of the reflector 200 and the like.

The sloping plane toward the reflector 200 is formed in the first body 310*a* and the second body 310*b*. Therefore, regarding a cross section of the light source unit 300 formed by coupling the first body 310*a*, the second body 310*b* and the middle body 320, the width of the lower part of the light source unit 300 is greater that of the upper part of the light source unit 300. For example, the cross section of the light source unit 300 can have various shapes such as a fan shape or a polygon shape and the like.

The first body 310*a* is formed to have a first coupling unit 315*a*. The first coupling unit 315*a* is an upper part of the first body 310*a* and is inserted into the insertion recess 112 of the coupling member 110.

The second body 310*b* is formed to have a second coupling unit 315*b*. The second coupling unit 315*b* is an upper part of the second body 310*b* and is inserted into the insertion recess 112 of the coupling member 110.

Due to the first coupling unit 315*a* and the second coupling unit 315*b*, the first body 310*a* and the second body 310*b* are higher than the middle body 320.

A projection 313 is formed in the upper ends of the first coupling unit 315*a* and the second coupling unit 315*b* respectively. The projection 313 has a shape in which a part of the upper end of each of the first coupling unit 315*a* and the second coupling unit 315*b* is projected outward. When the first coupling unit 315*a* and the second coupling unit 315*b* of the first body 310*a* and the second body 310*b* are inserted into the insertion recess 112 of the coupling member 110, the projection 313 is inserted into the third recess 113 formed in the insertion recess 112. As a result, the light source unit 300 is strongly coupled to the coupling member 110.

2) Middle Body 320

The middle body 320 is formed between the first body 310*a* and the second body 310*b*. Here, both inner surfaces of the first body 310*a* and the second body 310*b* are opposite to outer surfaces on which the light emitting diode 312 is mounted. A part of a lower surface of the middle body 320 can be exposed between the first body 310*a* and the second body 310*b*.

The second connection terminal 330 is formed in the middle body 320. When the light source unit 300 is inserted into and coupled to the coupling member 110, the second connection terminal 330 is electrically connected to the first connection terminal 120 by being coupled to the first connection terminal 120 formed in the insertion recess 112 of the coupling member 110. The power supply unit 400 provides electric power and/or a driving signal to the light source unit 300 through the first connection terminal 120 and the second connection terminal 330.

On the middle body 320, a spring 340 is disposed between the first body 310*a* and the second body 310*b*. For example, as shown in FIG. 4*b*, the spring 340 can have a '⊏'-shape and can be disposed contacting with the upper surface and the lateral surfaces of the first body 310*a* and the second body 310*b*. In more detail, the spring 340 is disposed contacting with the inner surfaces of the first coupling unit 315*a* and the second coupling unit 315*b*.

The spring 340 provides an elastic force to the first body 310*a* and the second body 310*b*, coupling securely the light source unit 300 to the insertion recess 112 of the coupling member 110. The spring 340 provides the first body 310*a* and the second body 310*b* with an elastic force widening a space between the first body 310*a* and the second body 310*b*. That is, the spring 340 is disposed between the first body 310*a* and the second body 310*b* and performs a function of pushing outward the first body 310*a* and the second body 310*b*. Accordingly, when the light source unit 300 is inserted into the coupling member 110, the projections 313 formed in the upper ends of the first body 310*a* and the second body 310*b* are strongly coupled to the insertion recess 112 of the coupling member 110 by the force from the spring 340.

A sensor 321 is included in the lower part of the middle body 320. For example, the sensor 321 is exposed between the first body 310*a* and the second body 310*b* and senses various data such as an image, a voice, a pressure, a temperature and an electric wave and the like.

The lighting device 1 includes the sensor 321, thereby providing a user with various functions including light. The various data sensed by the sensor 321 is connected with the operation of a plurality of the light emitting diodes 312 and is used for driving the lighting device 1 suitably for an environment. For example, luminances and color senses of a plurality of the light emitting diodes 312 are adjusted by the data sensed by the sensor 321.

The sensor 321 includes at least one of a camera, a photo sensor, a pressure sensor, a temperature sensor, a burglarproof sensor, an electric wave sensor and the like.

A limit switch 323 is provided on both sides of the middle body 320. The limit switch 323 is in an on-state or in an off-state as the first body 310*a* and the second body 310*b* move toward the middle body 320. The limit switch is hereby configured in such a manner as to connect or disconnect the electric power supplied to a plurality of the light emitting diodes 312. The detailed description of the limit switch 323 will be described later.

Heat generated from a plurality of the light emitting diodes 312 is radiated by the body of the light source unit 300 or is transferred to the coupling member 110 and radiated. Thus, it is desirable to form the first body 310*a*, the second body 310*b* and middle body 320 with a material capable of efficiently radiating heat. For example, the first body 310*a*, the second body 310*b* and middle body 320 can be formed of a metallic material such as Al, Sn, Ni, Ag, Cu, Ti, Mo, W, Au and Pt and so on. Additionally, a part of the light source unit 300 has an uneven structure capable of efficiently radiating heat.

When the light source unit 300 is inserted into the insertion recess 112 of the coupling member 110, there is an empty space between the light source unit 300 and the insertion recess 112. Therefore, heat generated from the light source unit 300 can be effectively released through the empty space. Additionally, a part of the light source unit 300 has an uneven structure capable of efficiently radiating heat.

When the light source unit 300 is inserted into the insertion recess 112 of the coupling member 110, there is a contact area between the inner surface of the insertion recess 112 and both the first coupling unit 315*a* and the second coupling unit 315*a*. As such, one surfaces of the first coupling unit 315*a* and the second coupling unit 315*b* contact with the inner surface of the insertion recess 112, thereby forming a thermal conductivity route from the light source unit 300 to the coupling member 110. In this case, the wider the contact surface is, the more increased a radiant heat effect is. But, the heights of the first body 310*a* and the second body 310*b* are increased. Consequently, the height of the housing 100 should be increased. Therefore, it is necessary to consider a relation between the contact area and the height of the housing 100 in order that the lighting device 1 obtains an optimized radiant heat effect.

In addition, in order to improve the heat radiating effect, it is preferable that the first body 310*a* and the second body 310*b* are made of a metallic material having a high thermal conductivity, such as Al and the like. Since electrical components are mounted in the middle body 320, it is required that heat should not be transferred to the middle body 320. Accordingly, the middle body 320 may be made of a material having low thermal conductivity, for example, plastic, in order to prevent heat generated from the first and the second bodies 310*a* and 310*b* from being transferred to the middle body 320.

3) Coupling Cap 350

The first body 310*a*, the second body 310*b* and middle body 320 are coupled to each other by coupling a coupling cap 350 to one ends thereof. Here, the first body 310*a*, the second body 310*b* and middle body 320 are coupled such that they can rotate.

As shown in FIG. 7, a first recess 361*a* is formed on one side in the middle of the first body 310*a*. A second recess 361*b* is formed on one side in the middle of the second body 310*b*. A third recess 361*c* is formed in the middle of the middle body 320. One side of each of the first recess 361*a* and the second recess 361*b* is opened to the outside of the light source unit 300.

A fourth recess 361*d* is formed on the other side of the lower part the first body 310*a*. A fifth recess 361*e* is formed on the other side of the lower part of the first body 310*b*. The sixth recess 361*f* is formed in the lower part of the middle body 320.

The coupling cap 350 includes a first deterrent protrusion 351*a*, a second deterrent protrusion 351*b*, an upper part fixing protrusion 351*c*, a first axis protrusion 351*d*, a second axis protrusion 351*e* and a lower part fixing protrusion 351*f*.

The first body 310*a*, the second body 310*b* and the middle body 320 are coupled to each other by inserting the first deterrent protrusion 351*a* into the first recess 361*a*, inserting the second deterrent protrusion 351*b* into the second recess 361*b*, inserting the upper part fixing protrusion 351*c* into the third recess 361*c*, inserting the first axis protrusion 351*d* into the fourth recess 361*d*, inserting the second axis protrusion 351*e* into the fifth recess 361*e*, and inserting the lower part fixing protrusion 351*f* into the third recess 361*f*.

The coupling cap 350 is fixed to the middle body 320 by inserting the upper part fixing protrusion 351*c* and the lower part fixing protrusion 351*f* into the third recess 361*c* and the sixth recess 361*f* respectively.

The spring 340 retains a force pushing outward the first body 310*a* and the second body 310*b*. When the force causes a space between the first body 310*a* and the second body 310*b* to be widened to a certain extent, the space between the first body 310*a* and the second body 310*b* is not widened any more because the first body 310*a* and the second body 310*b* are fixed by the first deterrent protrusion 351*a* and the second deterrent protrusion 351*b* respectively. In this case, a maximum angle between the first body 310*a* and the second body 310*b* is formed by the first deterrent protrusion 351*a* and the second deterrent protrusion 351*b*.

The first axis protrusion 351*d* is inserted into the fourth recess 361*d* and functions as an axis of rotation of the first body 310*a*. The second axis protrusion 351*e* is inserted into the fifth recess 361*e* and functions as an axis of rotation of the second body 310*b*. As a result, the first body 310*a* and the second body 310*b* can rotate about the first axis protrusion

351*d* and the second axis protrusion 351*e* respectively. Since one side of each of the first recess 361*a* and the second recess 361*b* is opened to the outside, the first recess 361*a* and the second recess 361*b* are separated from the first deterrent protrusion 351*a* and the second deterrent protrusion 351*b* respectively, during the rotations of the first body 310*a* and the second body 310*b*. The first axis protrusion 351*d* and the second axis protrusion 351*e* formed in the lower part of the coupling cap 350 are closely adjacent in order to function as axes of rotation.

Meanwhile, since the first body 310*a* and the second body 310*b* are formed to have the first sloping surface and the second sloping surface facing the reflector 200, with the viewpoint of a section of the light source unit 300 formed by the coupling of the first body 310*a*, the second body 310*b* and the middle body 320, the width of the lower part of the light source unit 300 is greater that of the upper part of the light source unit 300. For example, the light source unit 300 can have a fan-shaped section or a polygon-shaped section. The light source unit 300 can have various sections without being limited to this.

4) First Connection Terminal 120 and Second Connection Terminal 330

A first connection terminal 120 is provided in the middle part of the insertion grove 112 of the coupling member 110. A second connection terminal 330 is provided on the middle body 320 of the light source unit 300. The second connection terminal 330 is coupled to and electrically connected to the first connection terminal 120. Based on a design of the light source device 1, it is possible to form at least one or more the first connection terminals 120 and at least one or more the second connection terminals 330.

The first and the second connection terminals 120 and 330 may be electrically connected to each other by inserting the light source unit 300 into the insertion recess 112.

The first and the second connection terminals 120 and 330 is able to transfer electric power and/or a driving signal which are provided by the power supply unit 400 to the plurality of the light emitting diodes 312 and/or the sensor 321.

Figure 8:
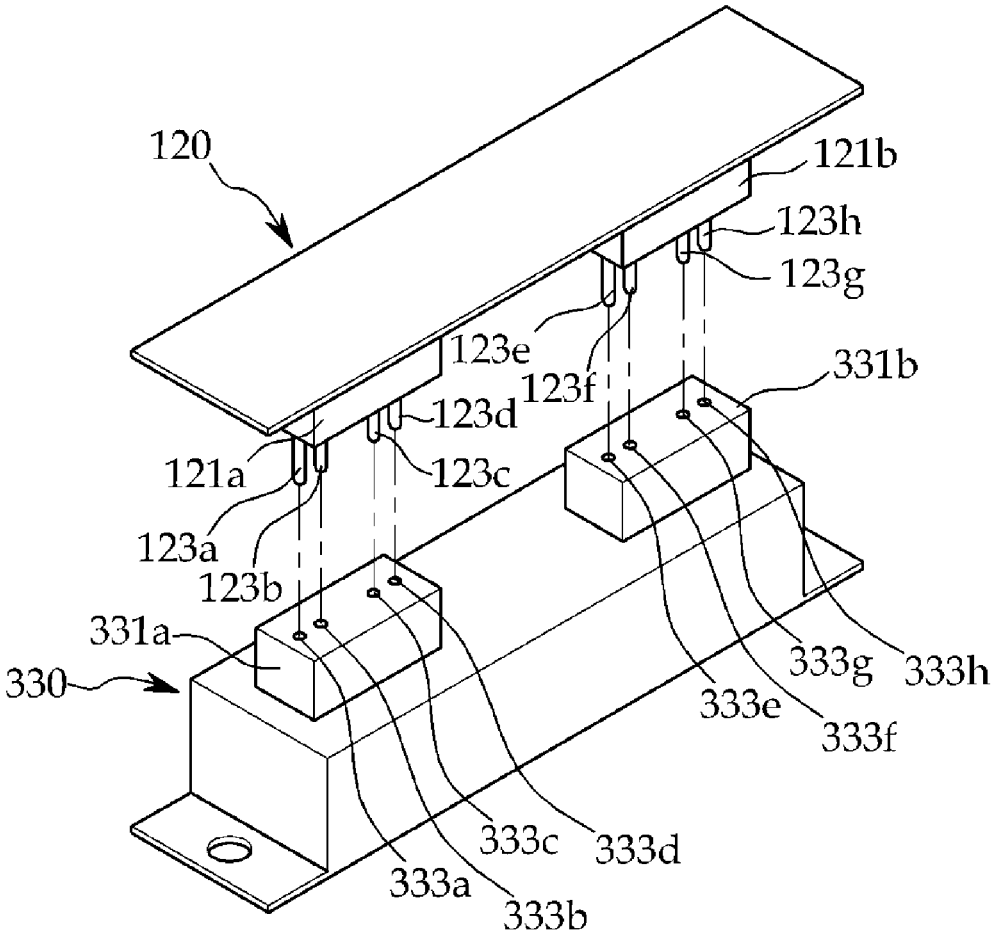
FIG. 8 is a perspective view of a coupling of a first connection terminal and a second connection terminal of a lighting device in accordance with the embodiment 1 of the present invention.
Figure 9A:
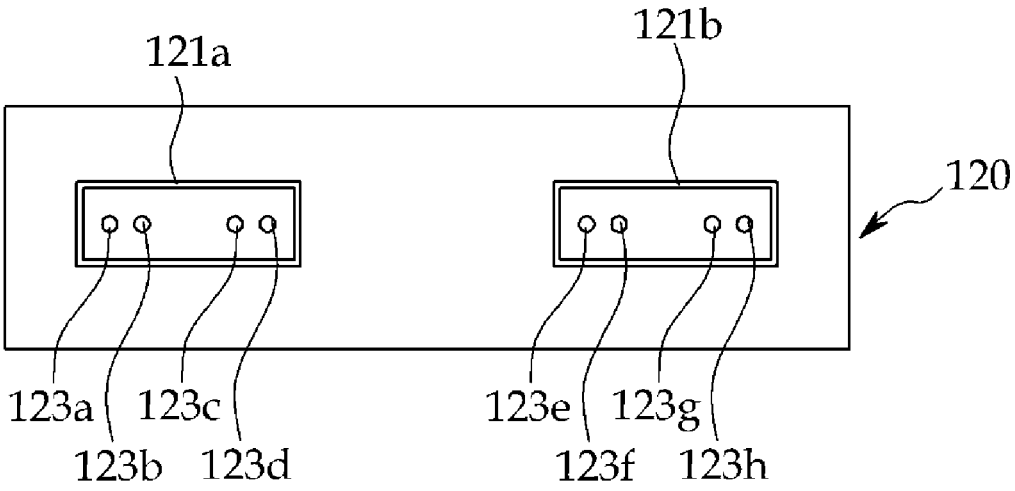
FIGS. 9*a* and 9*b* are plan views of a first connection terminal and a second connection terminal of a lighting device in accordance with the embodiment 1 of the present invention.
Figure 9B:
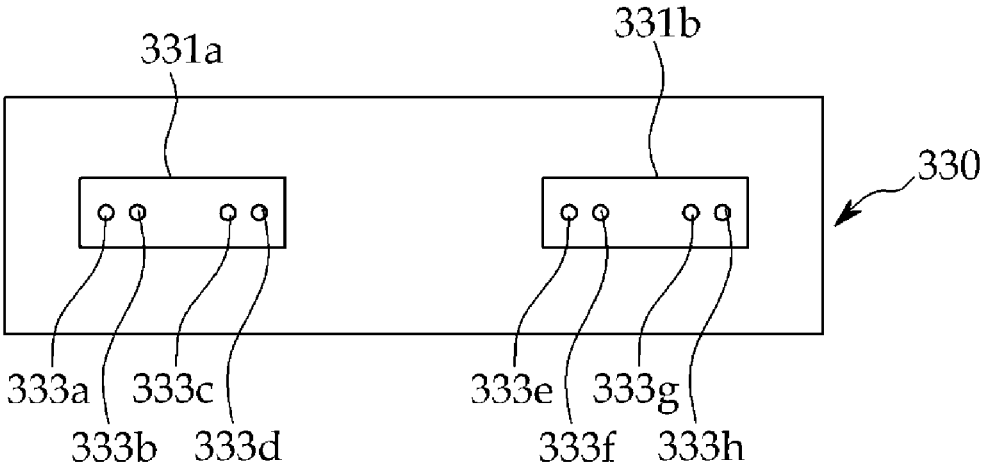

FIG. 8 is a perspective view of a coupling of a first connection terminal 120 and a second connection terminal 330 of a lighting device 1 in accordance with an embodiment 1 of the present invention. FIGS. 9*a* and 9*b* are plan views of a first connection terminal 120 and a second connection terminal 330 of a lighting device 1 in accordance with an embodiment 1 of the present invention.

The first connection terminal 120 includes a first female block 121*a* and a second female block 121*b* and without being limited to this, the first connection terminal 120 can include at least one pair of the female blocks.

For example, the first female block 121*a* includes a pair of a first terminal 123*a* and a second terminal 123*b* and another pair of a third terminal 123*c* and a fourth terminal 123*d*. The second female block 121*b* includes a pair of a fifth terminal 123*e* and a sixth terminal 123*f* and another pair of a seventh terminal 123*g* and an eighth terminal 123*h*.

The first female block 121*a* and the second female block 121*b* are symmetrical to each other. That is, the first to the fourth terminals 123*a* to 123*d* and the fifth to the eighth terminals 123*e* to 123*h* are symmetrical with respect to a line between the first female block 121*a* and the second female block 121*b*.

The second connection terminal 330 includes a first male block 331*a* and a second male block 331*b* and without being limited to this, the first connection terminal 120 can include at least one pair of the male blocks.

For example, the first male block 331*a* includes a pair of a first socket 333*a* and a second socket 333*b* and another pair of a third socket 333*c* and a fourth socket 333*d*. The second male block 331*b* includes a pair of a fifth socket 333*e* and a sixth socket 333*f* and another pair of a seventh socket 333*g* and an eighth socket 333*h*.

The first male block 331*a* and the second male block 331*b* are symmetrical to each other. That is, the first to the fourth sockets 333*a* to 333*d* and the fifth to the eighth sockets 333*e* to 333*h* are symmetrical with respect to a line between the first male block 331*a* and the second male block 331*b*.

A polarity of the first female block 121*a* and a polarity of the second female block 121*b* may be symmetrical to each other.

The polarities of the first and the second terminals 123*a* and 123*b* are symmetrical to the polarities of the seventh and the eighth terminals 123*g* and 123*h*. For example, if the polarities of the first and the second terminals 123*a* and 123*b* are '+' and '−' respectively, the polarities of the seventh and the eighth terminals 123*g* and 123*h* are '−' and '+' respectively. If the polarities of the first and the second terminals 123*a* and 123*b* are '−' and '+' respectively, the polarities of the seventh and the eighth terminals 123*g* and 123*h* are '+' and '−' respectively.

Additionally, the polarities of the third and the fourth terminals 123*c* and 123*d* are symmetrical to the polarities of the fifth and the sixth terminals 123*e* and 123*f*. For example, if the polarities of the third and the fourth terminals 123*c* and 123*d* are '+' and '−' respectively, the polarities of the fifth and the sixth terminals 123*e* and 123*f* are '−' and '+' respectively. If the polarities of the third and the fourth terminals 123*c* and 123*d* are '−' and '+' respectively, the polarities of the fifth and the sixth terminals 123*e* and 123*f* are '+' and '−' respectively.

The polarities of the first to the eighth sockets 333*a* to 333*h* can be various formed depending on the polarities of the first to the eighth terminals 123*a* to 123*h*.

When the light source unit 300 is coupled to the coupling member 110 in the first direction, the first connection terminal 120 is electrically and physically connected to the second connection terminal 330 by inserting the first and the second terminals 123*a* and 123*b* into the first and the second sockets 333*a* and 333*b*, inserting the third and the fourth terminals 123*c* and 123*d* into the third and the fourth sockets 333*c* and 333*d*, inserting the fifth and the sixth terminals 123*e* and 123*f* into the fifth and the sixth sockets 333*e* and 333*f*, inserting the seventh and the eighth terminals 123*g* and 123*h* into the seventh and the eighth sockets 333*g* and 333*h*.

In addition, when the light source unit 300 is coupled to the coupling member 110 in a second direction (that is, a reverse direction to the first direction), the first connection terminal 120 is electrically and physically connected to the second connection terminal 330 by inserting the first and the second terminals 123*a* and 123*b* into the seventh and the eighth sockets 333*g* and 333*h*, inserting the third and the fourth terminals 123*c* and 123*d* into the fifth and the sixth sockets 333*e* and 333*f*, inserting the fifth and the sixth terminals 123*e* and 123*f* into the third and the fourth sockets 333*c* and 333*d*, inserting the seventh and the eighth terminals 123*g* and 123*h* into the first and the second sockets 333*a* and 333*b*.

As such, since the structures and polarities of the first connection terminal 120 and the second connection terminal 330 are symmetrical to each other, it is possible to connect the light source unit 300 to the coupling member 110 irrespective of the coupling direction. Accordingly, the lighting device 1 according to the embodiment 1 makes it easier to couple the light source unit 300 to the coupling member 110, enhancing a convenience for use thereof.

In the meantime, when the light source unit 300 is coupled to the coupling member 110, the first, second, seventh and eighth terminals 123*a*, 123*b*, 123*g* and 123*h* are used as connectors for transferring electric power. The third, fourth, fifth and sixth terminals 123*c*, 123*d*, 123*e* and 123*f* are used or not used as connectors for transferring a driving signal.

On the contrary, the third, fourth, fifth and sixth terminals 123*c*, 123*d*, 123*e* and 123*f* can be used as connectors for transferring electric power. The first, second, seventh and eighth terminals 123*a*, 123*b*, 123*g* and 123*h* can be used or not used as connectors for transferring a driving signal.

Figure 10A:
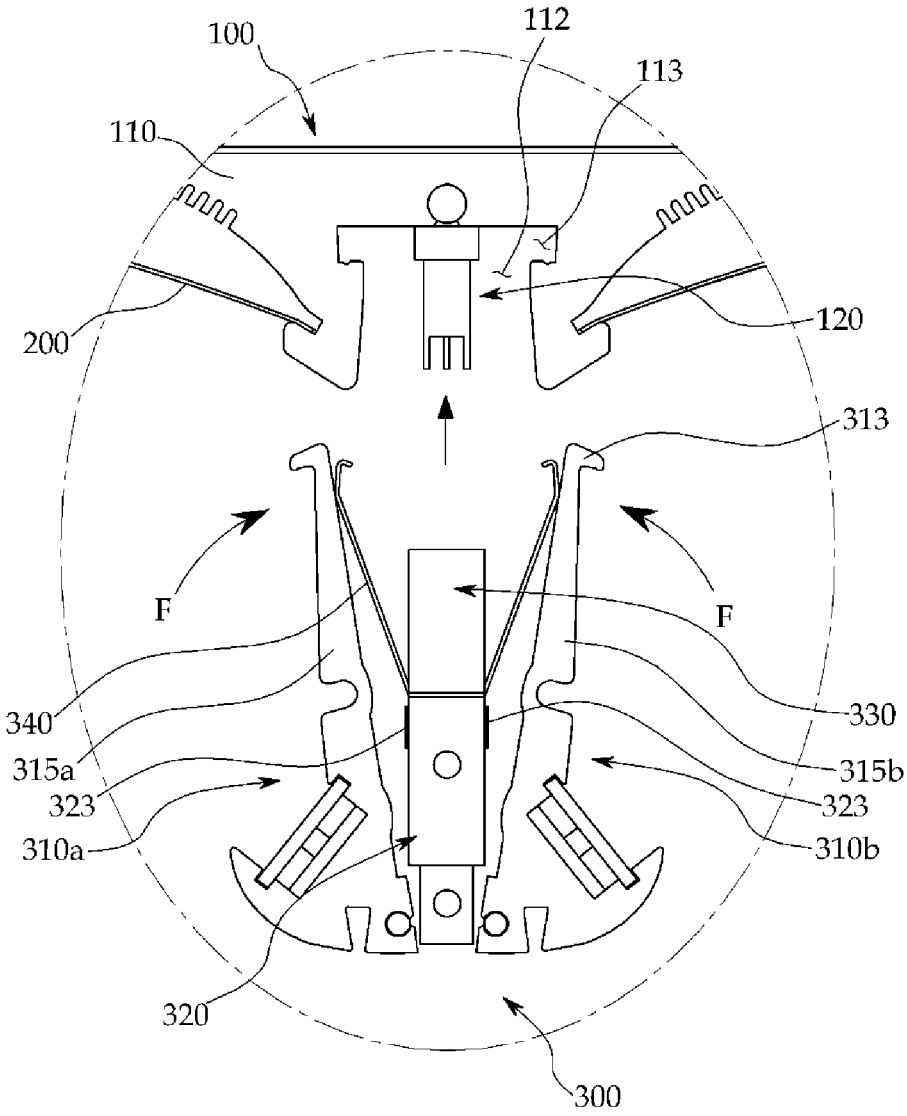
FIGS. 10*a* and 10*b* show a coupling and separation process of a light source unit and a coupling member in accordance with the embodiment 1 of the present invention.
Figure 10B:
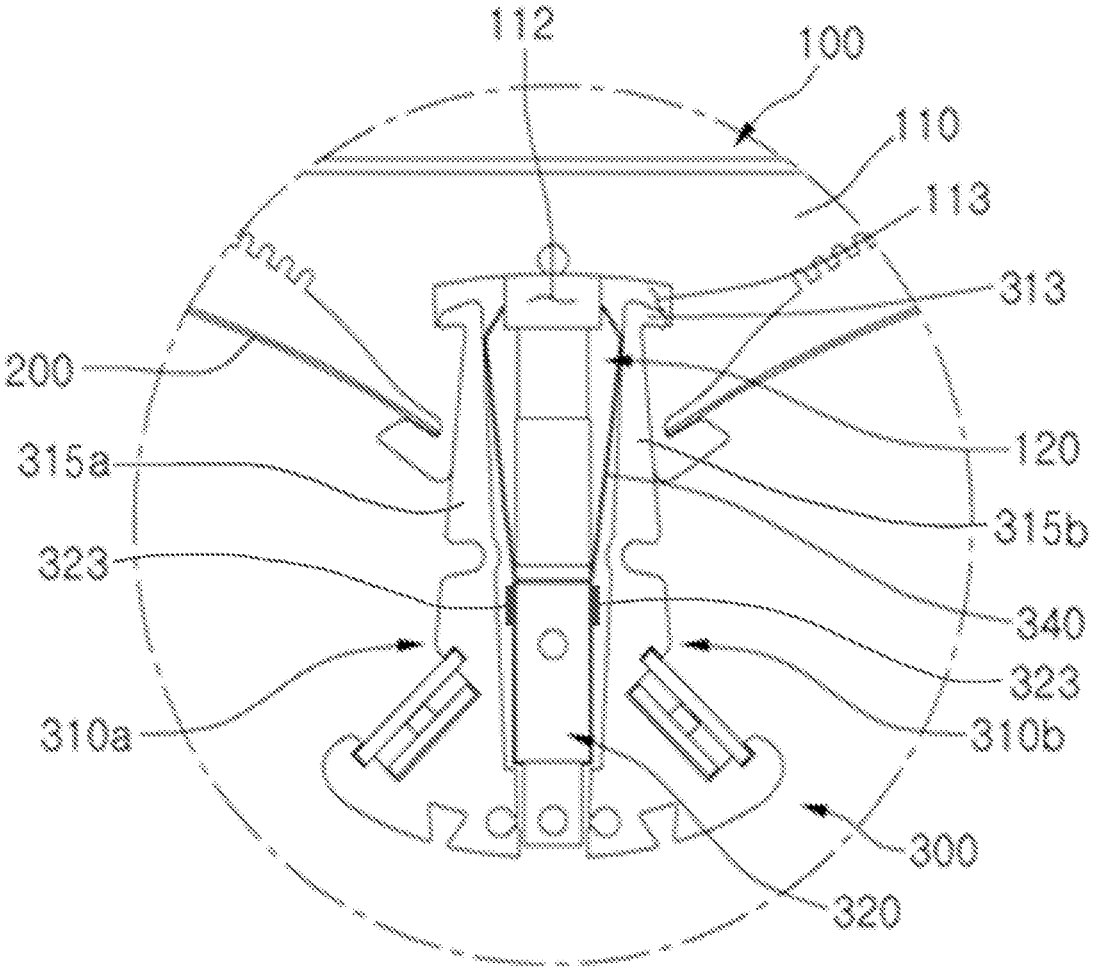

Coupling and Separation of Light Source Unit 300 and Coupling Member 110, and Operation of Limit Switch FIGS. 10*a* and 10*b* show a coupling and separation process of a light source unit 300 and a coupling member 110 in accordance with an embodiment 1 of the present invention.

Coupling Process

First, as shown in FIG. 10*a*, in the light source unit 300, an angle between the first body 310*a* and the second body 310*b* is reduced by applying a first force F to the first body 310*a* and the second body 310*b* which are coupled such that they can rotate about the lower part of the light source unit 300. Here, the direction of the first force F is reverse to the direction of the elastic force applied by the spring 340. When the lower parts of the first and the second coupling units 315*a* and 315*b* are pressed by applying the first force F, a space between the first and the second coupling units 315*a* and 315*b* is reduced, so that an angle between the first body 310*a* and the second body 310*b* is reduced.

If the first force F is not applied, a space between the first body 310*a* and the second body 310*b* is widened by the elastic force applied by the spring 340, so that it is difficult to insert the light source unit 300 into the insertion recess 112 of the coupling member 110.

As mentioned above, as a space between the first and the second coupling units 315*a* and 315*b* is reduced, the first and the second bodies 310*a* and 310*b* approach close to or come in contact with both sides of the middle body 320. Here, a limit switch 323 detects the motions of the first and the second bodies 310*a* and 310*b* and becomes in an off-state, and then disconnects the electric power supplied to the light emitting diode 312.

In general, a lighting device such as a fluorescent lamp can be replaced while the lighting device is connected to a power supply. However, when a lighting device using the light emitting diode 312 is connected to a power supply and is replaced, the light emitting diode 312 may be damaged. To overcome such a problem, through the use of the limit switch 323, the lighting device according to the embodiment 1 recognizes an operation in which the first and the second bodies 310*a* and 310*b* move toward the middle body 320 as an operation of replacing the light source. As a result, during the operation of replacing the light source, it is possible to disconnect the electric power supplied to the light emitting diode 312.

As shown in FIG. 10*b*, as the first force F is applied to the first and the second bodies 310*a* and 310*b*, the light source unit 300 is inserted into the insertion recess 112 of the coupling member 110. Here, if the first force F is not applied, a space between the first and the second bodies 310*a* and 310*b* is widened again, so that the projection 313 is inserted into the third recess 113 formed on the inner surface of the insertion recess 112. As a result, the light source unit 300 can be coupled to the coupling member 110.

When the light source unit 300 is inserted into the coupling member 110, the spring 340 disposed between the first body 310*a* and the second body 310*b* pushes the first body 310*a* and the second body 310*b*, causing the projections 313 to be more securely coupled to the third recess 113.

The spring 340 gives continuously a uniform pressure to a contact surface formed by causing the first coupling unit 315*a* and the second coupling unit 315*b* to be contact with the insertion recess 112. Therefore, heat generated from the light source unit 300 can be more efficiently transferred through the contact surface mentioned above.

As described above, when the light source unit 300 is thoroughly coupled to the coupling member 110, the space between the first and the second bodies 310*a* and 310*b* is widened again by the elastic force from the spring 340. The limit switch 323 hereby recognizes that the operation of replacing the light source is completed and becomes in an off-state, and then connects again the electric power supplied to the light emitting diode 312.

2) Separation Process

When the light source unit 300 is required to repair, the light source unit 300 can be separated from the coupling member 110.

In separating the light source unit 300 from the coupling member 110, after the angle between the first body 310*a* and the second body 310*b* is reduced by applying the first force F to the first body 310*a* and the second body 310*b*, the light source unit 300 is separated from the coupling member 110.

An Example of Limit Switch

Figure 11A:
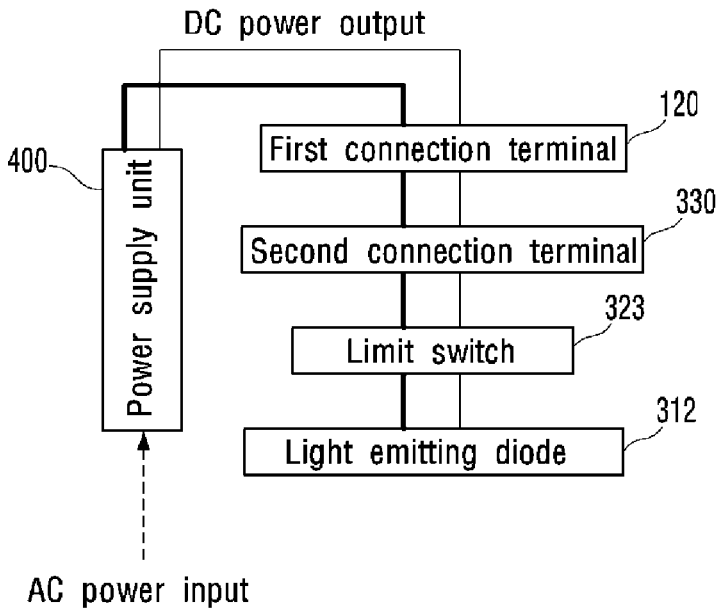
FIGS. 11*a* and 11*b* show how a limit switch in accordance with the embodiment 1 is operated.
Figure 11B:
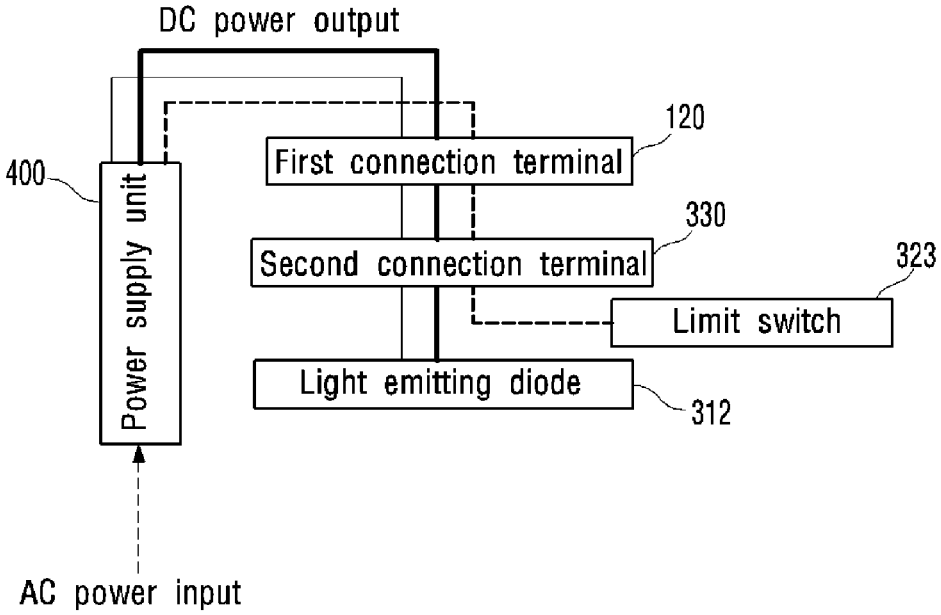

FIG. 11*a* shows how a mechanical limit switch according to an embodiment 1 is operated. FIG. 11*b* shows how a sensor type limit switch according to an embodiment 1 is operated.

The limit switch according to the embodiment 1 is able to employ a mechanical limit switch or a sensor type limit switch.

Mechanical Limit Switch

When the first force F is applied to the first and the second bodies 310*a* and 310*b*, the first and the second bodies 310*a* and 310*b* rotate in the direction of the middle body 320, so that the inner surfaces of the first and the second bodies 310*a* and 310*b* approach close to both sides of the middle body 320 respectively. When the first and the second bodies 310*a* and 310*b* approach close to both sides of the middle body 320 to a certain extent respectively, the limit switch 323 contacts with the first and the second bodies 310*a* and 310*b*. Here, the limit switch 323 disposed on both sides of the middle body 320 is pressed through the use of button by the first and the second bodies 310*a* and 310*b* and becomes in an off-state. In this case, the limit switch 323 is capable of electrically separating the second connection terminal 330 from the light emitting diode 312.

Next, after the light source unit 300 is completely coupled to the coupling member 110, a distance between the first body 310*a* and the second body 310*b* is increased. As a result, the limit switch 323 becomes in an on-state, so that the second connection terminal 330 may be electrically connected again to the light emitting diode 312.

2) Sensor Type Switch

When the first force F is applied to the first and the second bodies 310*a* and 310*b*, the first and the second bodies 310*a* and 310*b* rotate in the direction of the middle body 320, so that the inner surfaces of the first and the second bodies 310*a* and 310*b* approach close to both sides of the middle body 320 respectively. Here, the limit switch 323 disposed on both sides of the middle body 320 detects the motions of the first and the second bodies 310*a* and 310*b*.

There are two kinds of the aforementioned detecting method. One is a method using the intensity of pressure applied by the first and the second bodies 310*a* and 310*b* and the other is a method using a magnetic field intensity measured from the first and the second bodies 310*a* and 310*b*.

The limit switch 323 using the intensity of pressure may include a pressure sensor. Such a limit switch 323 measures the intensity of pressure applied by the first and the second bodies 310*a* and 310*b*. If the measured intensity of pressure is greater than a predetermined intensity of pressure, the limit switch 323 becomes in an off-state. Here, the limit switch 323 recognizes that the light source is replaced and may generate a control signal for disconnecting the electric power supplied to the light source 300.

Subsequently, when the first connection terminal 120 is connected to the second connection terminal 330, the control signal generated by the limit switch 323, as shown in FIG. 11*b*, may be output to the power supply unit 400 through the first connection terminal 120 and the second connection terminal 330. As a result, the power supply unit 400 is hereby able to disconnect the electric power output based on the control signal.

After the light source 300 is completely coupled to the coupling member 110, as the first force F is decreased, a distance between the limit switch 323 and both the first and the second bodies 310*a* and 310*b* is increased. Since the first and the second bodies 310*a* and 310*b* are further from the limit switch 323, the intensity of pressure applied by the first and the second bodies 310*a* and 310*b* becomes lower than a predetermined intensity of pressure. In this case, the limit switch 323 becomes in an on-state, the control signal is not output. In such a case, the second connection terminal 330 may be electrically connected again to the light emitting diode 312.

The limit switch 323 using the magnetic field intensity may include a magnetic sensor. The limit switch 323 using the magnetic field intensity has the same electrical operation method as that of the limit switch 323 using the pressure sensor. However, in case of the limit switch 323 using the magnetic sensor, a magnet is provided on the inner surfaces of the first and the second bodies 310*a* and 310*b*. The position of the magnet corresponds to the position of the magnetic sensor. Accordingly, it is possible to measure the magnetic field intensity according to a distance between the middle body 320 and the first and the second bodies 310*a* and 310*b*.

The limit switch 323 using the magnetic sensor is able to recognize the existence, approach and location of an object through a non contact method. The limit switch 323 using the non contact method may be produced by using various proximity sensors as well as the aforementioned magnetic sensor.

Meanwhile, the middle body 320 may include a separate power supply for starting and operating the limit switch 323.

According to the embodiment 1, when the light source unit 300 is required to be disposed or replaced for maintenance, it is possible to safely attach or remove the light source unit 300 by using the limit switch 323 even though the lighting device is in a live status.

Modified Embodiment

Figure 12:
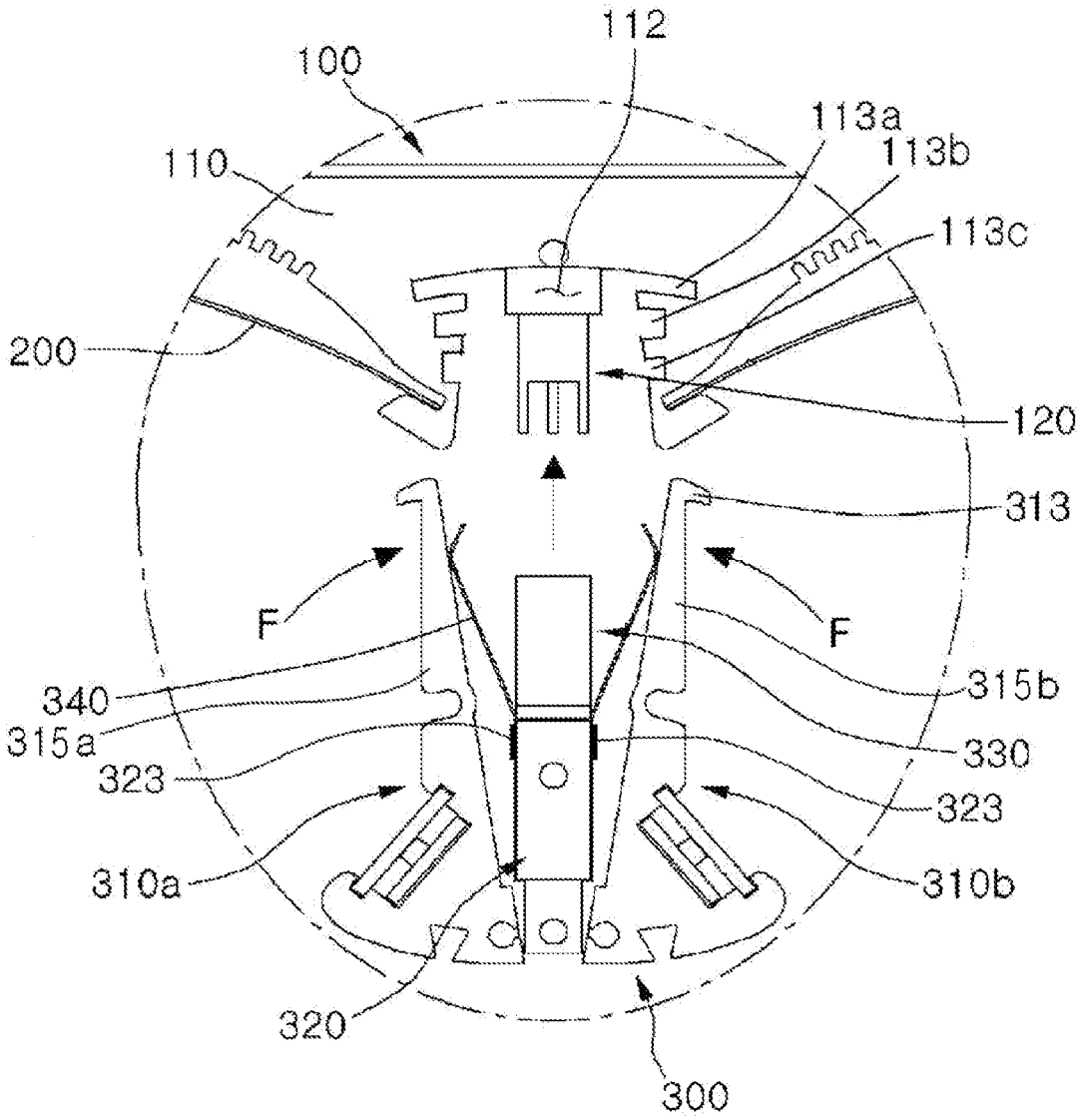
FIGS. 12 and 13 are cross sectional views showing a light source unit and a coupling member of a lighting device in accordance with a modified embodiment 1.
Figure 13:
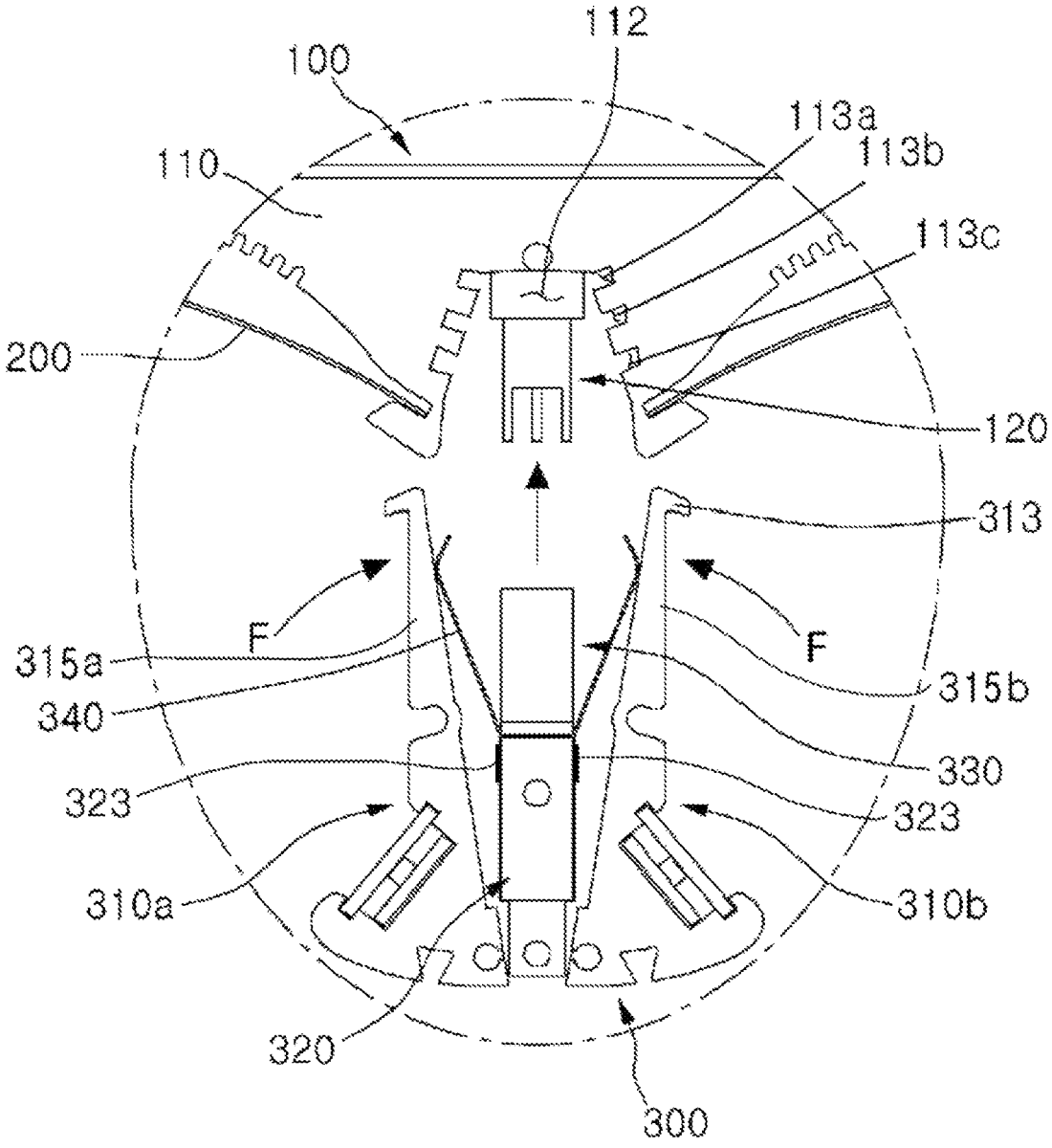

FIGS. 12 and 13 are cross sectional views of a light source unit 300 and a coupling member 110 of a lighting device in accordance with a modified embodiment of the present invention. In description of the lighting device 1 according to a modified embodiment, repetitive descriptions thereof will be omitted.

Referring to FIGS. 12 and 13, a plurality of the third recesses 113*a*, 113*b* and 113*c* are formed on the inner surface of the insertion recess 112 of the coupling member 110 of the lighting device 1. While the three third recesses 113*a*, 113*b* and 113*c* are shown, there is no limit to the number of the third recesses.

The light source unit 300 is inserted into and coupled to the insertion recess 112. Here, the projection 313 of the upper part of the light source unit 300 is inserted into one of a plurality of the third recesses 113*a*, 113*b* and 113*c*, so that the light source unit 300 is strongly coupled to the coupling member 110.

As shown in FIG. 12, depths of a plurality of the third recesses 113*a*, 113*b* and 113*c* are different from each other, it is possible to diversely adjust the light distribution of the lighting device 1 in accordance with one of a plurality of the third recesses 113*a*, 113*b* and 113*c* into which the projection 313 of the light source unit 300 is inserted.

As shown in FIG. 13, the insertion recess 112 has a sloping inner surface. When a plurality of the third recesses 113*a*, 113*b* and 113*c* are formed on the sloping inner surface of the insertion recess 112, an angle between the first body 310*a* and the second body 310*b* of the light source unit 300 varies in accordance with one of a plurality of the third recesses 113*a*, 113*b* and 113*c* into which the projection 313 of the light source unit 300 is inserted. Therefore, it is possible to diversely adjust the light distribution of the lighting device 1.

As described above, it is possible to diversely adjust the light distribution of the lighting device 1 by forming a plurality of the third recesses 113*a*, 113*b* and 113*c* on the inner surface of the insertion recess 112. As a result, even though a width or curvature of the reflector 200 changes, it is possible to provide an efficient lighting without changing the light source unit 300.

Embodiment 2

Figure 14:
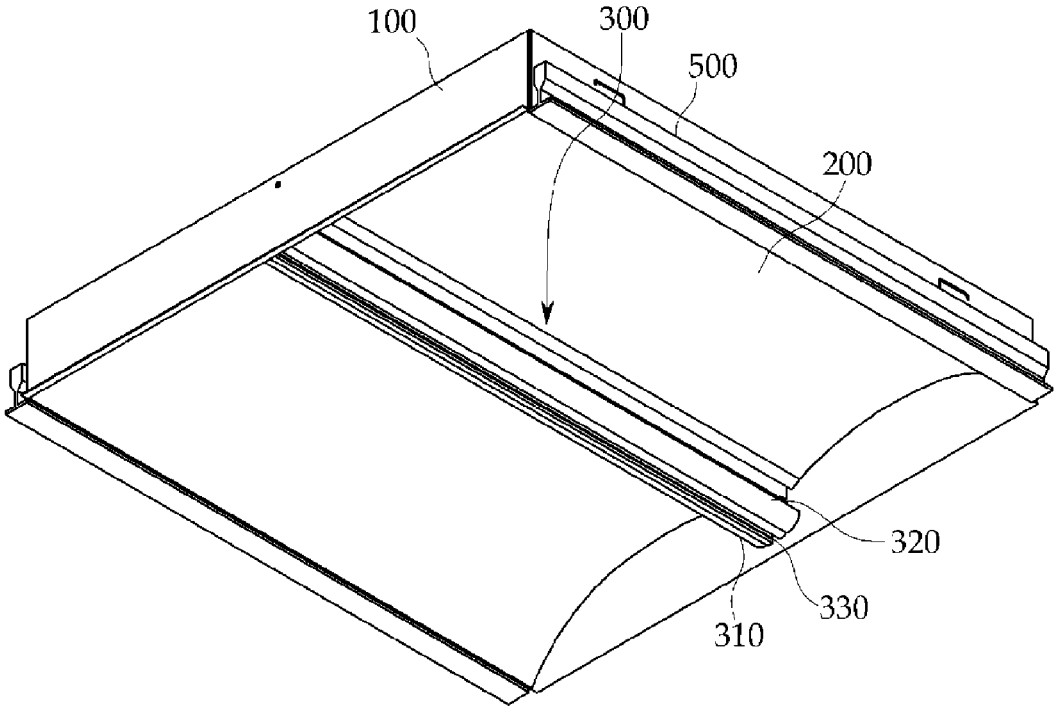
FIG. 14 is a perspective view of a light device in accordance with an embodiment 2 of the present invention.
Figure 15:
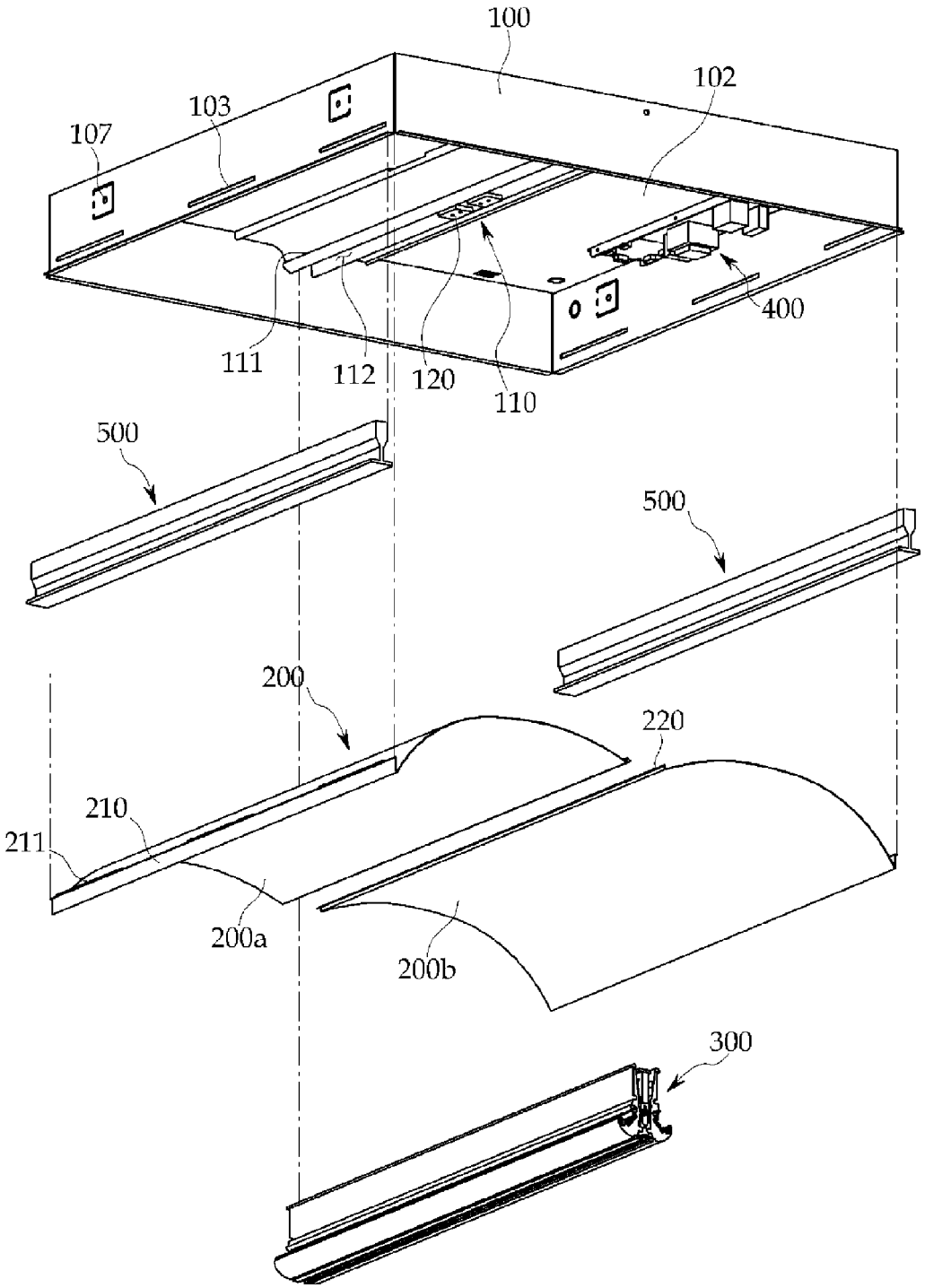
FIG. 15 is an exploded perspective view of the light device in accordance with the embodiment 2 of the present invention.
Figure 16:
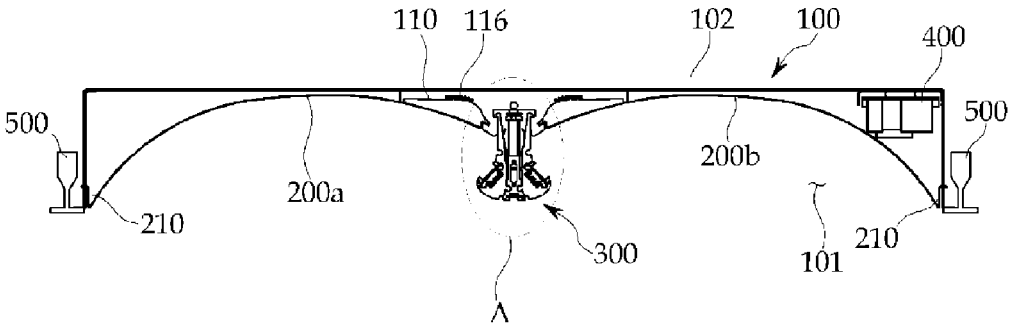
FIG. 16 is a cross sectional view of the light device in accordance with the embodiment 2 of the present invention.
Figure 17A:
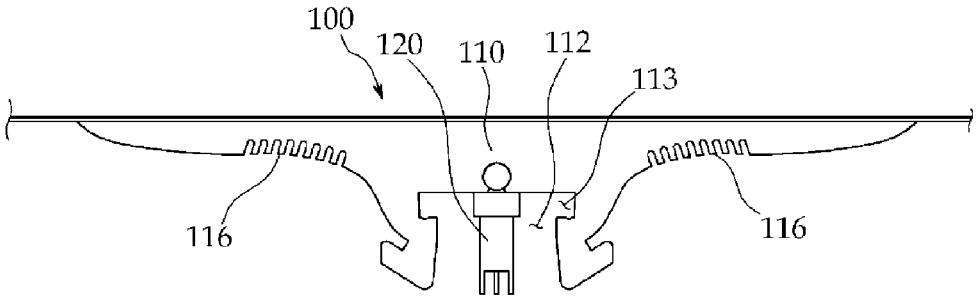
FIG. 17*a* is a cross sectional view of a coupling member shown in FIG. 16.
Figure 17B:
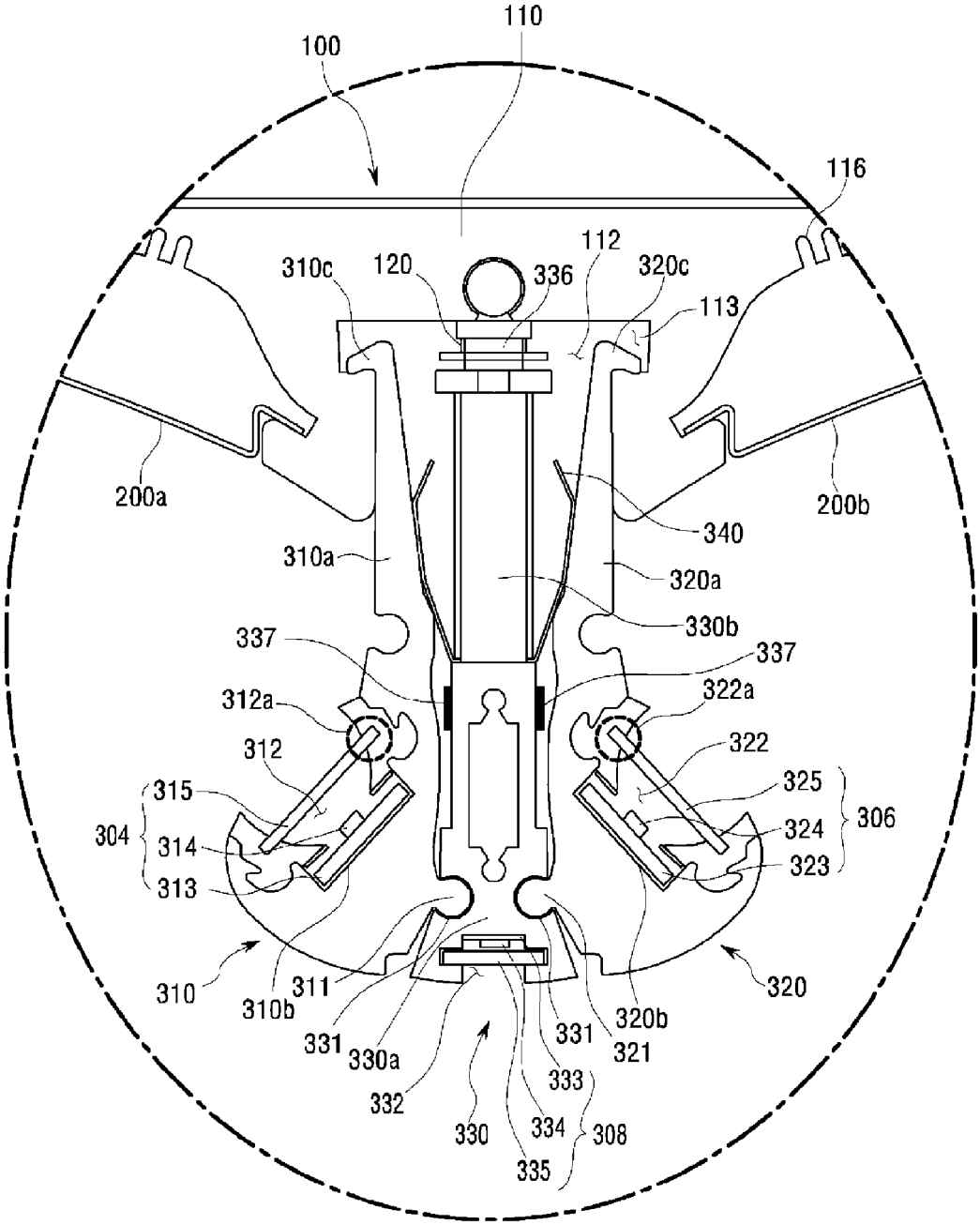
FIG. 17*b* is a view showing an enlarged part denoted by "A" of FIG. 16.
Figure 17C:
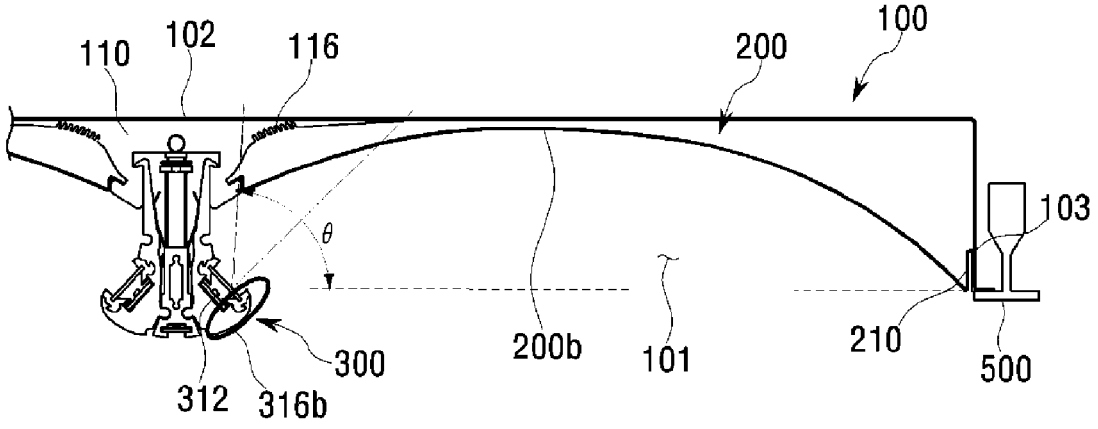
FIG. 17*c* is a view showing a light distribution angle of a light emitting diode mounted in the light emitting recess according to the embodiment 2 of the present invention.

FIG. 14 is a perspective view of a light device in accordance with an embodiment 2 of the present invention. FIG. 15 is an exploded perspective view of the light device in accordance with the embodiment 2 of the present invention. FIG. 16 is a cross sectional view of the light device in accordance with the embodiment 2 of the present invention. FIG. 17*a* is a cross sectional view of a coupling member shown in FIG. 16. FIG. 17*b* is a view showing an enlarged part denoted by "A" of FIG. 16. FIG. 17*c* is a view showing a light distribution angle of a light emitting diode mounted in the light emitting recess according to the embodiment 2 of the present invention.

In FIGS. 14 to 17*c*, a lighting device in accordance with an embodiment 2 of the present invention includes a housing 100, a coupling member 110, a reflector 200, a light source unit 300 and a power supply unit 400.

Housing 100 and Coupling Member 110

The housing 100 has a shape of a box for accepting the housing 100, the coupling member 110, the reflector 200 and the power supply unit 400. While the shape of the housing 100 as viewed from the outside is quadrangular, the housing 100 can have various shapes without being limited to this.

The housing 100 is made of a material capable of efficiently releasing heat. For example, the housing 100 is made of a metallic material such as Al, Sn, Ni, Ag, Cu, Ti, Mo, W, Au and Pt and so on.

A connecting recess 107 for connecting electrically the power supply unit 400 to an external power supply is formed on a lateral surface and/or an upper surface of the housing 100.

The housing 100 includes an opening 101 such that light radiated from the light source unit 300 is reflected to be emitted by the reflector 200.

Meanwhile, in order to dispose the lighting device on an external support member such as a ceiling or a wall surface, an insertion unit corresponding to a shape of the lighting device is formed in the external support member, and then the lighting device is inserted into and fixed to the insertion unit. Here, a coupling frame 500 is coupled to the lower part of the lateral surface of the housing 100, so that the lighting device can be securely coupled to the external support member.

The coupling member 110 is coupled on an inner upper surface of the housing 100. The coupling member 110 is coupled to the housing 100 by using various methods. For example, the coupling member 110 is coupled to the housing 100 by means of a coupling screw, an adhesive agent and so on.

The coupling member 110 is formed to be extended on an upper surface 102 of the housing 100 in a first direction. For example, the coupling member 110 can be extended from an inner wall surface to the opposite inner wall surface of the housing 100.

The housing 100 and the coupling member 110 are attachable to and removable form the reflector 200.

A second recess 103 is formed on the inner wall surface of the housing 100. A first side 210 of the reflector 200 is inserted into the second recess 103. It is possible to form the one second recess 103 or a plurality of the second recesses 103.

A first recess 111 is formed on an outer wall surface of the coupling member 110. The first recess 111 is formed to be extended in the first direction. A second side 220 of the reflector 200 is inserted into the first recess 111.

The housing 100 and the coupling member 110 can fix and sustain the reflector 200 by inserting the first side 210 of the reflector 200 into the second recess 103 of the housing 100 and by inserting the second side 220 of the reflector 200 into the first recess 111 of the coupling member 110.

A first insertion recess 112 is formed in the middle part of the coupling member 110. A part of the light source unit 300 is inserted into the first insertion recess 112. The first insertion recess 112 can be formed to be extended in the first direction.

A plurality of third recesses 113 are formed on an inner wall surface of the first insertion recess 112. A projection 313 of the light source unit 300 is inserted into the third recess 113. As a result, the light source unit 300 is securely coupled to the coupling member 110 by means of the third recess 113. The coupling of the light source unit 300 and the coupling member 110 will be described later in more detail.

A first connection terminal 120 is formed in the middle part within the first insertion recess 112. When the light source unit 300 is inserted into the first insertion recess 112, the first connection terminal 120 is coupled to and electrically connected to a second connection terminal 336 of the light source unit 300. When the first connection terminal 120 is connected to the second connection terminal 336, electric power and/or a driving signal can be transferred to the light source unit 300 through the first connection terminal 120 and the second connection terminal 336.

Based on a design of the light source device, it is possible to form the one first connection terminal 120 or a plurality of the first connection terminals 120. More detailed descriptions of the first connection terminal 120 and the second connection terminal 336 will be provided later.

The coupling member 110 performs a function of directly releasing heat generated from the light source unit 300 or transferring the heat to the housing 100.

It is desirable to form the coupling member 100 by using a material capable of efficiently releasing and/or transferring the heat. For example, the coupling member 110 is made of a metallic material such as Al, Sn, Ni, Ag, Cu, Ti, Mo, W, Au and Pt and so on.

A part of the coupling member 110 can have an uneven structure 116. The uneven structure 116 can widen the surface area of the coupling member 110 and improve a heat release effect.

2. Reflector 200

The reflector 200 includes a first reflector 200*a* and a second reflector 200*b*. The first reflector 200*a* and the second reflector 200*b* are attachable to and removable from the housing 100 and the coupling member 110.

For example, as shown in FIG. 15, the second reflector 200*b* is coupled to the housing 100 and the coupling member 110 by inserting the second side 220 of the second reflector 200*b* into the first recess 111 of the coupling member 110 and by inserting the first side 210 of the second reflector 200*b* into the second recess 103 of the housing 100. The second side 220 of the reflector 200 can have a level difference. The first side 210 of the reflector 200 can also have a level difference. At least one insertion end 211 which is inserted into the second recess 103 is formed at the first side 210 of the reflector 200. A shape of the second recess 103 is formed to correspond to the selection end 211.

The first reflector 200*a* and the second reflector 200*b* have a parabola-shaped surface and are extended in the first direction. Therefore, the first reflector 200*a* and the second reflector 200*b* have a parabolic shape having two parabolic surfaces. Here, the shape of the reflector 200 can be variously changed according to a desired lighting.

The reflector 200 is made of a metallic material or a resin material which has a high reflection efficiency. For example, the resin material includes any one of PET, PC and PVC resin. The metallic material includes any one of Ag, alloy including Ag, Al, and alloy including Al.

The surface of the reflector 200 is coated with Ag, Al, white photo solder resist (PSR) ink, a diffusion sheet and the like. Otherwise, an oxide film is formed on the surface of the reflector 200 by an anodizing process.

Here, the material and color of the reflector 200 are not limited and are variously selected depending on a lighting generated by the lighting device.

3. Power Supply Unit 400

When the power supply unit 400 is connected to the light source unit 300, the power supply unit 400 can supply at least one of electric power and a driving signal.

As shown in FIGS. 15 and 16, the power supply unit 400 is disposed in a space between the parabola-shaped reflector 200 and the inner surface of the housing 100. That is, due to the parabola shape of the reflector 200, an empty space is formed between the reflector 200 and a corner inside the housing 100. As a result, the power supply unit 400 is disposed in the empty space.

The power supply unit 400 converts an alternating current (AC) electric power into a direct current (DC) electric power and outputs the direct current (DC) electric power.

The power supply unit 400 is electrically connected to the light source unit 300 through a wire or a flexible printed circuit board (FPCB). For example, a wire or a FPCB is extended from the power supply unit 400 and is electrically connected to the first connection terminal 120 through the connecting recess 107 formed in the coupling member 110. The first connection terminal 120 is electrically connected to the second connection terminal 336. As a result, the power supply unit 400 is electrically connected to the light source unit 300.

4. Light Source Unit 300

Figure 18:
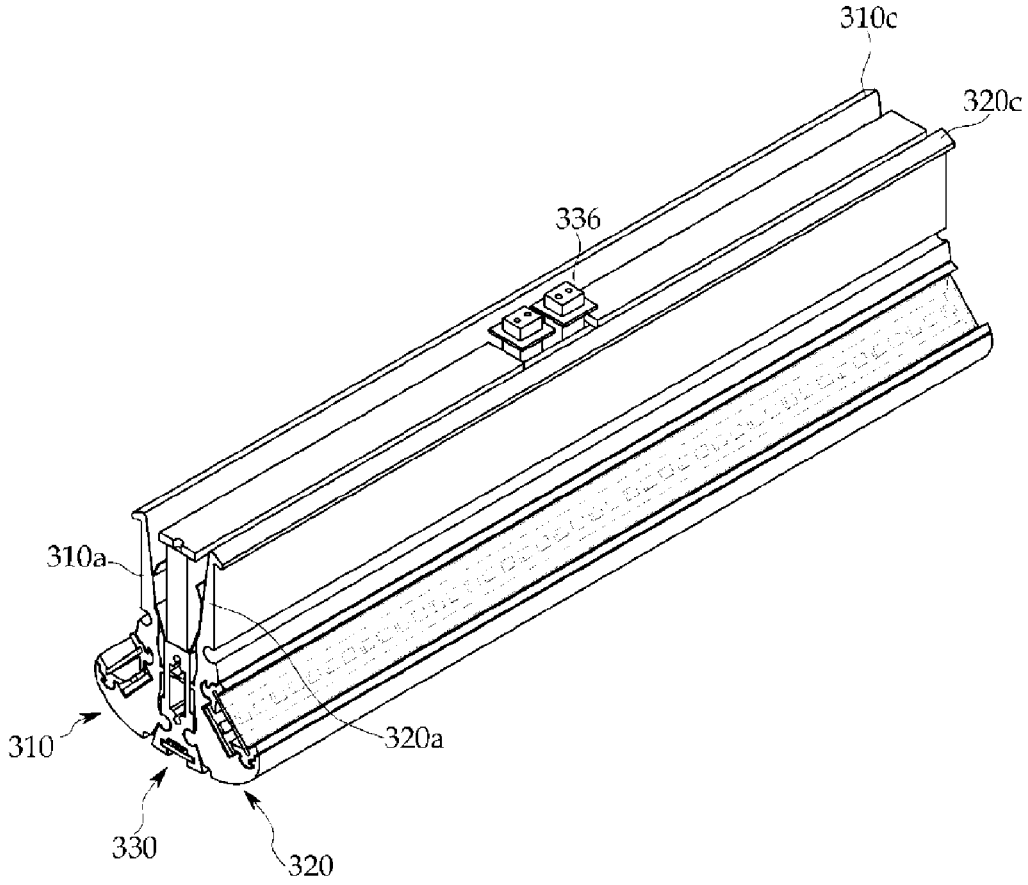
FIG. 18 is a perspective view of a light source unit in accordance with the embodiment 2 of the present invention.
Figure 19:
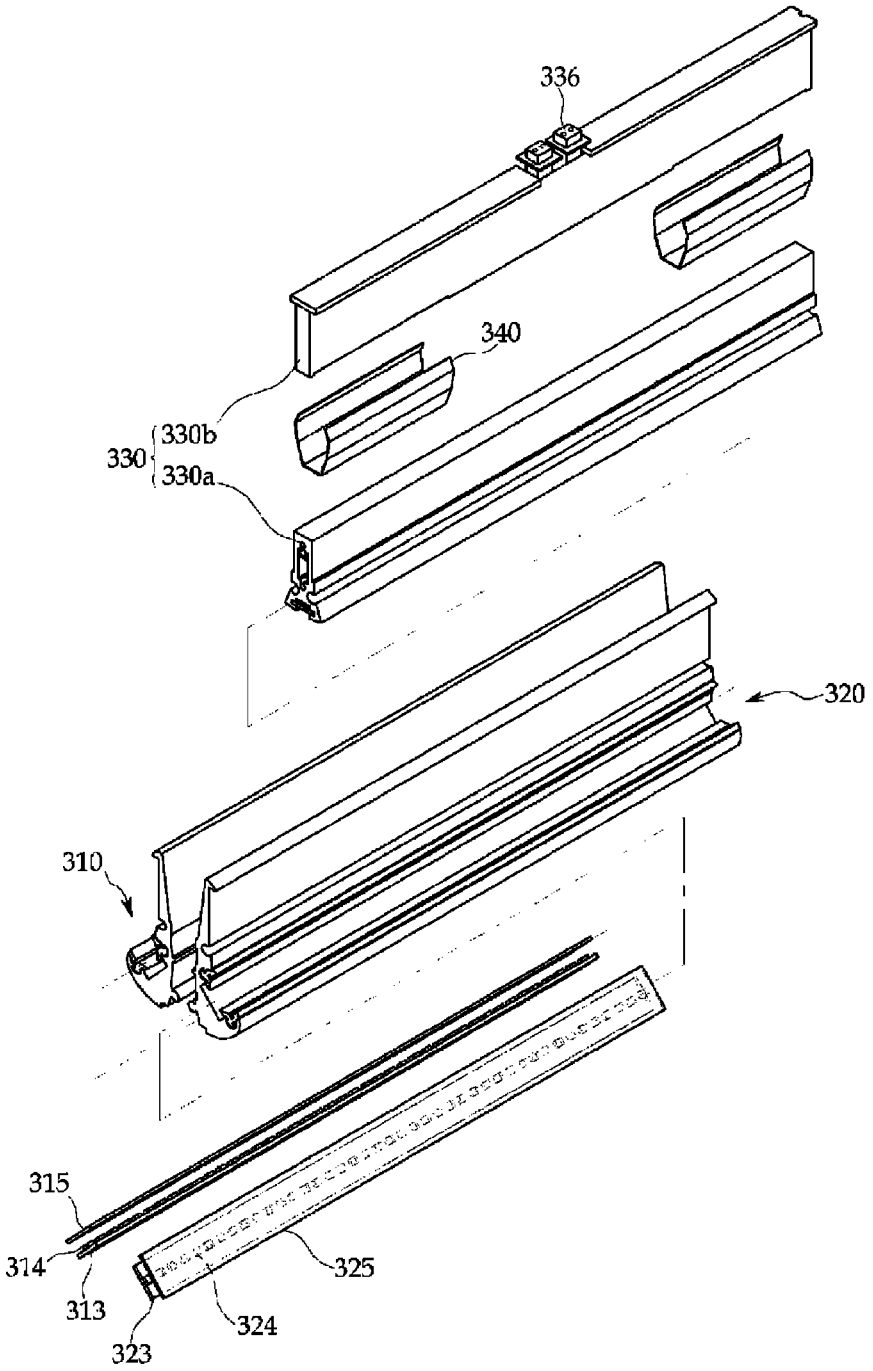
FIG. 19 is an exploded perspective view of the light source unit in accordance with the embodiment 2 of the present invention.

FIG. 17*a* is a cross sectional view of a coupling member shown in FIG. 16. FIG. 17*b* is a view showing an enlarged part denoted by "A" of FIG. 16. FIG. 17*c* is a view showing a light distribution angle of a light emitting diode mounted in the light emitting recess according to the embodiment 2 of the present invention. FIG. 18 is a perspective view of the light source unit 300 in accordance with the embodiment 2 of the present invention. FIG. 19 is an exploded perspective view of the light source unit 300 in accordance with the embodiment 2 of the present invention.

Referring to FIGS. 17*a* to 19, the light source unit 300 according to the embodiment 2 of the present invention includes a first body 310, a second body 320, a middle body 330, a first main light emitting diode module 304, a second main light emitting diode module 306, an auxiliary light emitting diode module 308 and a spring 340. The body of the light source unit 300 includes the first body 310, the second body 320 and the middle body 330. The light source unit 300 may be extended in the first direction, that is, in the direction of length of the reflector 200.

Hereinafter, the structure of the light source unit 300 will be described in more detailed.

First Body 310

A first coupling unit 310*a* is formed in the upper part of the first body 310. The first coupling unit 310*a* constitutes the upper part of the first body 310 and is inserted into the first insertion recess 112 of the coupling member 110.

A first projection 310*c* is formed in the upper end of the first coupling unit 310*a*. The first projection 310*c* has a shape in which a part of the upper end of the first coupling unit 310*a* is projected outward.

A first light emitting recess 312 is formed on one side of the lower part of the first body 310. The basal surface of the first light emitting recess 312 is formed to have a first sloping surface 310*b*. The first sloping surface 310*b* is formed to face the parabolic surface of the first reflector 200*a*. Here, a plurality of the sloping surfaces as well as the first sloping surface 310*b* may be formed in the first body 310.

The first main light emitting diode module 304 is disposed in the first light emitting recess 312. The first main light emitting diode module 304 includes a first substrate 313, a plurality of main light emitting diodes 314 and a first optical structure 315.

The first substrate 313 is disposed on the basal surface of the first light emitting recess 312 along the first sloping surface 310*b*.

The plurality of the main light emitting diodes 314 are disposed on the first substrate 313 along the first sloping surface 310*b* and are electrically connected to the first substrate 313. Otherwise, a plurality of electrodes (not shown) are disposed on the first sloping surface 310*b*, and then the plurality of the main light emitting diodes 314 are electrically connected to the plurality of electrodes (not shown) respectively. Such a plurality of the main light emitting diodes 314 may be arranged within the first light emitting recess 312 in the form of an array.

The plurality of the main light emitting diodes 314 are determined, for example, through various combinations of red, green, blue and white light emitting diode which radiate red, green, blue and white light respectively.

The plurality of the main light emitting diodes 314 are controlled by electric power and/or a driving signal which are provided by the power supply unit 400, causing the plurality of the main light emitting diodes 314 to selectively emit light or to adjust the luminance of light.

The first optical structure 315 is disposed on the plurality of the main light emitting diodes 314. The first optical structure 315 functions to adjust the light distribution and the color sense of light radiated from the plurality of the main light emitting diodes 314, and creates emotional lighting having various luminance and color senses if necessary.

The first optical structure 315 is coupled to the inside of the first light emitting recess 312 by inserting in a sliding way both ends of the first optical structure 315 into a fourth recess 312*a* formed on an inner surface of the first light emitting recess 312. More specifically, the fourth recess 312*a* is extended in the first direction and the first optical structure 315 is coupled to the inside of the first light emitting recess 312 by being inserted into the fourth recess 312*a* in the first direction.

The first optical structure 315 includes at least one of a lens, a diffusion sheet and a phosphor luminescent film (PLF).

The lens includes various lenses such as a concave lens, a convex lens and a condensing lens and so on according to a design of the lighting device.

The diffusion sheet diffuses evenly light radiated from the plurality of the main light emitting diodes 314.

The phosphor luminescent film (PLF) includes fluorescent substance. Since the fluorescent substance included in the phosphor luminescent film (PLF) is excited by light radiated from the plurality of the main light emitting diodes 314, the lighting device can produce emotional lighting having various color senses by mixing a first light radiated from the plurality of the main light emitting diodes 314 and a second light excited by the fluorescent substance. For example, when the plurality of the main light emitting diodes 314 radiate blue light and the phosphor luminescent film (PLF) includes a yellow fluorescent substance excited by blue light, the lighting device radiates white light by mixing the blue light and yellow light.

The first optical structure 315 is easily coupled to the first light emitting recess 312 through the fourth recess 312*a*. Accordingly, a lens, a diffusion sheet and a phosphor luminescent film (PLF) can be alternately used as the first optical structure 315.

The depth and width of the first light emitting recess 312 can be variously adjusted according to the light distribution of the plurality of the main light emitting diodes 314 disposed within the first light emitting recess 312. In other words, the lighting device is able to cause the reflector 200 to provide users with light radiated from the light source unit 300 by adjusting the depth and width of the first light emitting recess 312 instead of directly providing users with light radiated from the light source unit 300. As a result, it is possible to provide users with subdued light by reducing glare.

A light distribution angle of light emitted from the first light emitting recess 312 is from 90° to 110°. The depth and width of the first light emitting recess 312 is formed to cause light emitted from the first light emitting recess 312 to be incident evenly on the entire area of the reflector 200.

Additionally, the depth and width of the first light emitting recess 312 is adjusted such that a part of light radiated from the plurality of the main light emitting diodes 314 is radiated to the outside through the opening 101 and the rest of the light is reflected by the reflector 200 and is radiated to the outside through the opening 101.

A first hinge 311 may be formed on the other side of the lower part of the first body 310. The first hinge 311 has a shape protruding outward. Also, the first hinge 311 may be extended in the first direction.

2) Second Body 320

A second coupling unit 320*a* is formed in the upper part of the second body 320. The second coupling unit 320*a* constitutes the upper part of the second body 320 and is inserted into the first insertion recess 112 of the coupling member 110.

A second projection 320*c* is formed in the upper end of the second coupling unit 320*a*. The second projection 320*c* has a shape in which a part of the upper end of the second coupling unit 320*a* is projected outward.

A second light emitting recess 322 is formed on one side of the lower part of the second body 320. The basal surface of the second light emitting recess 322 is formed to have a second sloping surface 320*b*. The second sloping surface 320*b* is formed to face the parabolic surface of the second reflector 200*b*. Here, a plurality of the sloping surfaces as well as the second sloping surface 320*b* may be formed in the second body 320.

The second main light emitting diode module 306 is disposed in the second light emitting recess 322. The second main light emitting diode module 304 includes a first substrate 323, a plurality of main light emitting diodes 324 and a first optical structure 325.

The first substrate 323 is disposed on the basal surface of the second light emitting recess 322 along the second sloping surface 320*b*.

The plurality of the main light emitting diodes 324 are disposed on the first substrate 323 along the second sloping surface 320*b* and are electrically connected to the first substrate 323. Otherwise, a plurality of electrodes (not shown) are disposed on the second sloping surface 320*b*, and then the plurality of the main light emitting diodes 324 are electrically connected to the plurality of electrodes (not shown) respectively. Such a plurality of the main light emitting diodes 324 may be arranged within the second light emitting recess 322 in the form of an array.

The plurality of the main light emitting diodes 324 are determined, for example, through various combinations of red, green, blue and white light emitting diode which radiate red, green, blue and white light respectively.

The plurality of the main light emitting diodes 324 are controlled by electric power and/or a driving signal which are provided by the power supply unit 400, causing the plurality of the main light emitting diodes 324 to selectively emit light or to adjust the luminance of light.

The first optical structure 325 is disposed on the plurality of the main light emitting diodes 324. The first optical structure 325 functions to adjust the light distribution and the color sense of light radiated from the plurality of the main light emitting diodes 324, and creates emotional lighting having various luminance and color senses if necessary.

The first optical structure 325 is coupled to the inside of the second light emitting recess 322 by inserting in a sliding way both ends of the first optical structure 325 into a fourth recess 322*a* formed on an inner surface of the second light emitting recess 322. More specifically, the fourth recess 322*a* is extended in the first direction and the first optical structure 325 is coupled to the inside of the second light emitting recess 322 by being inserted into the fourth recess 322*a* in the first direction.

The first optical structure 325 includes at least one of a lens, a diffusion sheet and a phosphor luminescent film (PLF).

The lens includes various lenses such as a concave lens, a convex lens and a condensing lens and so on according to a design of the lighting device.

The diffusion sheet diffuses evenly light radiated from the plurality of the main light emitting diodes 324.

The phosphor luminescent film (PLF) includes fluorescent substance. Since the fluorescent substance included in the phosphor luminescent film (PLF) is excited by light radiated from the plurality of the main light emitting diodes 324, the lighting device can produce emotional lighting having various color senses by mixing a first light radiated from the plurality of the main light emitting diodes 324 and a second light excited by the fluorescent substance. For example, when the plurality of the main light emitting diodes 324 radiate blue light and the phosphor luminescent film (PLF) includes a yellow fluorescent substance excited by blue light, the lighting device radiates white light by mixing the blue light and yellow light.

The first optical structure 325 is easily coupled to the second light emitting recess 322 through the fourth recess 322*a*. Accordingly, a lens, a diffusion sheet and a phosphor luminescent film (PLF) can be alternately used as the first optical structure 325.

The depth and width of the second light emitting recess 322 can be variously adjusted according to the light distribution of the plurality of the main light emitting diodes 324 disposed within the second light emitting recess 322. In other words, the lighting device is able to cause the reflector 200 to provide users with light radiated from the light source unit 300 by adjusting the depth and width of the second light emitting recess 322 instead of directly providing users with light radiated from the light source unit 300. As a result, it is possible to provide users with subdued light by reducing glare.

A light distribution angle of light emitted from the second light emitting recess 322 is from 90° to 110°. The depth and width of the second light emitting recess 322 is formed to cause light emitted from the second light emitting recess 322 to be incident evenly on the entire area of the reflector 200.

Additionally, the depth and width of the second light emitting recess 322 is adjusted such that a part of light radiated from the plurality of the main light emitting diodes 324 is radiated to the outside through the opening 101 and the rest of the light is reflected by the reflector 200 and is radiated to the outside through the opening 101.

A second hinge 321 may be formed on the other side of the lower part of the second body 320. The second hinge 321 has a shape protruding outward. Also, the second hinge 321 may be extended in the first direction.

As described above, the first body 310 and the second body 320 have the same structure and configuration.

Also, the first body 310 and the second body 320 may be manufactured in such a manner as to have a constant cross section in the first direction by means of an extrusion molding method.

Also, the first body 310 and the second body 320 may be formed of metallic material such as Al, Sn, Ni, Ag, Cu, Ti, Mo, W, Au and Pt and the like so as to release heat generated from the plurality of the main light emitting diodes 314 and 324.

Generally, the light distribution angle of the light emitted from the light emitting diode is about 120°. When the light emitting diode emits the light having such a wide light distribution angle, a part of the emitted light is reflected by the reflector 200 and is emitted to the outside through the opening 101. However, the rest of the light is directly emitted through the opening 101 to the outside, thereby enabling a user to feel glare.

To overcome such a problem, the first and the second light emitting recesses 312 and 322 may be formed to block the light emitted directly from the light emitting diodes 314 and 324 to the outside of the housing 100. That is, the first and the second light emitting recesses 312 and 322 includes a projection part 316*b* formed on the basal surface thereof, thereby blocking the light emitted directly from the light emitting diodes 314 and 324 to the outside of the housing 100.

As a result, due to the projection part 316*b* of the light emitting recess 316, the light emitted from a plurality of the light emitting diodes 314 and 324 is not directly provided to a user and is uniformly incident on the whole area of the reflector 200. Accordingly, it is possible to provide users with subdued light by reducing glare.

Furthermore, it is possible to block the direct light emitted from the light emitting diodes 314 and 324 to the outside of the housing 100 by adjusting the depth and width of the first and the second light emitting recesses 312 and 322, the height of the projection part 316*b*, the sloping angle of the basal surface 316*a*, the height of the housing 100 or the width of the reflector 200 and the like.

The sloping plane toward the reflector 200 is formed in the first body 310 and the second body 320. Therefore, regarding a cross section of the light source unit 300 formed by coupling the first body 310, the second body 320 and the middle body 330, the width of the lower part of the light source unit 300 is greater that of the upper part of the light source unit 300. For example, the cross section of the light source unit 300 can have various shapes such as a fan shape or a polygon shape and the like.

3) Middle Body 330

A second insertion recess 331 is formed on both sides of the lower part 330*a* of the middle body 330. The second insertion recess 331 is extended in the first direction. Here, the first hinge 311 of the first body 310 and the second hinge 321 of the second body 320 are inserted into the second insertion recess 331. For example, the first hinge 311 and the second hinge 321 may be inserted into the second insertion recess 331 respectively in a sliding way. The first body 310 and the second body 320 are hereby coupled to both sides of the middle body 330 in an attachable and removable manner. Also, the first body 310 and the second body 320 may be coupled to rotate about the first hinge 311 and the second hinge 321 respectively.

An auxiliary light emitting diode module 308 is disposed on the basal surface of the lower part 330*a* of the middle body 330. More specifically, a third light emitting recess 332 is formed on the basal surface of the lower part of the middle body 330, and the auxiliary light emitting diode module 308 is disposed within the third light emitting recess 332. The auxiliary light emitting diode module 308 includes a second substrate 333, a plurality of auxiliary light emitting diodes 334 and a second optical structure 335.

The second substrate 333 is disposed on the inner upper surface of the third light emitting recess 332.

The plurality of the auxiliary light emitting diodes 334 are disposed on the second substrate 333 and are electrically connected to the second substrate 333. Otherwise, a plurality of electrodes (not shown) are disposed on the inner upper surface of the third light emitting recess 332, and then the plurality of the auxiliary light emitting diodes 334 are electrically connected to the plurality of electrodes (not shown) respectively.

The second optical structure 335 is coupled to the inside of the third light emitting recess 332 by inserting in a sliding way both ends of the third optical structure 335 into a fifth recess 332*a* formed on the inner surface of the third light emitting recess 332. More specifically, the fifth recess 332*a* is extended in the first direction and the second optical structure 335 is coupled to the inside of the third light emitting recess 332 by being inserted into the fifth recess 332*a* in the first direction.

The plurality of the auxiliary light emitting diodes 334 are controlled by electric power and/or a driving signal which are provided by the power supply unit 400, causing the plurality of the auxiliary light emitting diodes 334 to selectively emit light or to adjust the luminance of light. For example, the auxiliary light emitting diode 334 is used in producing more illuminations, a subdued lighting condition and a display apparatus and the like.

The second optical structure 335 is disposed on the plurality of the auxiliary light emitting diodes 334. The second optical structure 335 functions to adjust the light distribution and the color sense of light radiated from the plurality of the auxiliary light emitting diodes 334, and creates emotional lighting having various luminance and color senses if necessary.

The second optical structure 335 includes at least one of a lens, a diffusion sheet and a phosphor luminescent film (PLF).

The lens includes various lenses such as a concave lens, a convex lens and a condensing lens and so on according to a design of the lighting device.

The diffusion sheet diffuses evenly light radiated from the plurality of the main light emitting diodes 314.

The phosphor luminescent film (PLF) includes fluorescent substance. Since the fluorescent substance included in the phosphor luminescent film (PLF) is excited by light radiated from the plurality of the main light emitting diodes 314, the lighting device can produce emotional lighting having various color senses by mixing a first light radiated from the plurality of the main light emitting diodes 314 and a second light excited by the fluorescent substance. For example, when the plurality of the main light emitting diodes 314 radiate blue light and the phosphor luminescent film (PLF) includes a yellow fluorescent substance excited by blue light, the lighting device radiates white light by mixing the blue light and yellow light.

The second optical structure 335 is easily coupled to the third light emitting recess 332 through the fifth recess 332*a*. Accordingly, a lens, a diffusion sheet and a phosphor luminescent film (PLF) can be alternately used as the first optical structure 315.

The middle body 330 according to the embodiment 2 may be manufactured in such a manner as to have a constant cross section in the first direction and to have a symmetrical structure by means of an extrusion molding method.

As described above, when the first body 310, the second body 320 and the middle body 330 are coupled to each other, the outer surfaces of the first hinge 311 and the second hinge 321 are in contact with the inner surface of the second insertion recess 331, so that a heat release path can be created between the first body 310, the second body 320 and the middle body 330.

Therefore, in order to improve the heat radiating effect, the lower part 330*a* of the middle body 330 is made of a metallic material having high thermal conductivity, for example, Al, Sn, Ni, Ag, Cu, Ti, Mo, W, Au and Pt and the like. Since electrical components are mounted in the upper part 330*b* of the middle body 330, it is to be desired that heat is not transferred to the upper part 330*b* of the middle body 330. Therefore, the upper part of the middle body 330 is made of a material having low thermal conductivity, for example, plastic material and the like such that it is possible to prevent the heat generated by the first body 310, the second body 320 and the lower part of the middle body 330 from being transferred.

Further, the heat generated from the main light emitting diodes 314 and 324 and the auxiliary light emitting diode 334 is released by the body of the light source unit 300 or is transferred to the coupling member 110, and then is released.

That is, when the light source unit 300 is inserted into the first insertion recess 112 of the coupling member 110, the first coupling unit 310*a* and the second coupling unit 320*a* have a contact area with the first insertion recess 112. As such, one sides of the first coupling unit 310*a* and the second coupling unit 320*a* contact with the inner surface of the first insertion recess 112, a thermal conductivity route from the light source unit 300 to the coupling member 110 can be formed. Here, the larger the contact area is, the higher the heat radiating effect is. However, the heights of the first body 310 and the second body 320 are increased, so that the height of the housing 100 is required to be increased. Accordingly, in order for the lighting device to have optimal heat radiating effect, it is necessary to consider the relationship between the contact area and the height of the housing 100. A part of the body of the light source unit 300 has an uneven structure, thereby effectively releasing the heat.

Meanwhile, the coupling unit 110 of the housing 100 includes the first insertion recess 112 of which the inner wall surface is extended by the length of the light source unit 300 (that is, extended in the first direction). The light source includes a light source safe holder contacting directly with a light source and having the light source seated therein, and includes the first coupling unit 310*a* and the second coupling unit 320*a* which come in surface contact with the inner wall surface of the first insertion recess 112 formed in the coupling unit 110. Here, the light source safe holder signifies the light emitting recess in which the light emitting diodes are disposed and signifies the lower part of the light source unit 300 in which the light emitting recess is formed.

When the lighting device is operated, heat generated from the light source safe holder is released to the coupling unit 110 through the first coupling unit 310*a* and the second coupling unit 320*a*. In this case, the first coupling unit 310*a* and the second coupling unit 320*a* come in surface contact with the inner wall surface of the first insertion recess 112, so that the heat generated from the light source safe holder can be transferred to the coupling unit 110. Here, since the inner wall surface of the first insertion recess 112 is extended by the length of the light source unit 300 (that is, extended in the first direction), a maximum contact area of the first coupling unit 310*a* and the second coupling unit 320*a* is obtained. As a result, it is possible to improve the heat radiating effect of the lighting device.

Meanwhile, the lower parts of the first body 310 and the second body 320 are manufactured to have sloping surfaces toward the reflector 200. Therefore, regarding a cross section of the light source unit 300 formed by coupling the first body 310, the second body 320 and the middle body 330, the width of the lower part of the light source unit 300 is greater that of the upper part of the light source unit 300. For example, the cross section of the light source unit 300 has a fan shape or a polygon shape and the like. However, the cross section of the light source unit 300 can have various shapes without being limited to the shapes mentioned above.

4) Spring 340

A spring 340 is disposed in the upper part or in the middle part of the middle body 330. For example, as shown in FIG. 17*b*, the spring 340 can have a 'ㄷ'-shape and can be disposed between the lower part 330*a* and the upper part 330*b* of the middle body 330. When the first body 310 and the second body 320 are coupled to each other on both sides of the middle body 330, the spring 340 is disposed contacting with the inner surfaces of the first body 310 and the second body 320.

The spring 340 provides the first body 310 and the second body 320 with an elastic force widening a space between the first body 310 and the second body 320. That is, the spring 340 is disposed between the first body 310 and the second body 320 and performs a function of pushing outward the first body 310 and the second body 320. Accordingly, when the light source unit 300 is inserted into the coupling member 110, the projections formed in the upper ends of the first body 310 and the second body 320 are strongly coupled to the first insertion recess 112 of the coupling member 110 by the force from the spring 340.

5) First Connection Terminal 120 and Second Connection Terminal 336

Figure 20:
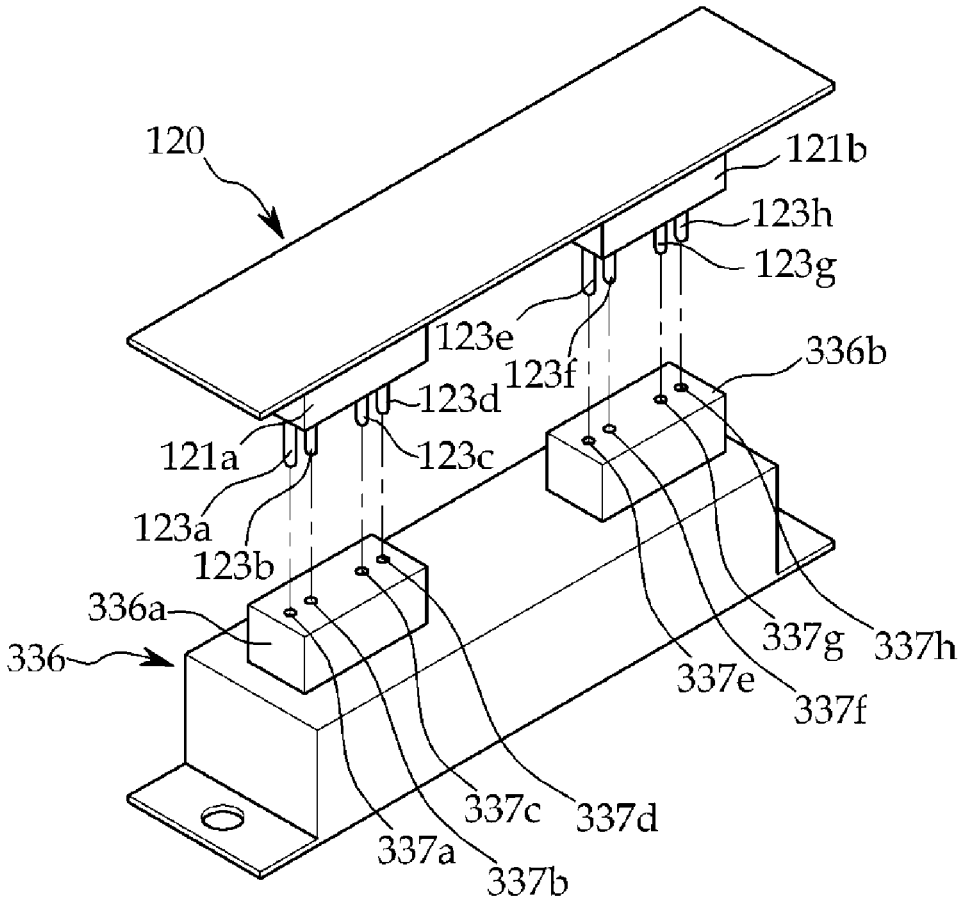
FIG. 20 is a perspective view of a coupling of a first connection terminal and a second connection terminal of the lighting device in accordance with the embodiment 2 of the present invention.
Figure 21A:
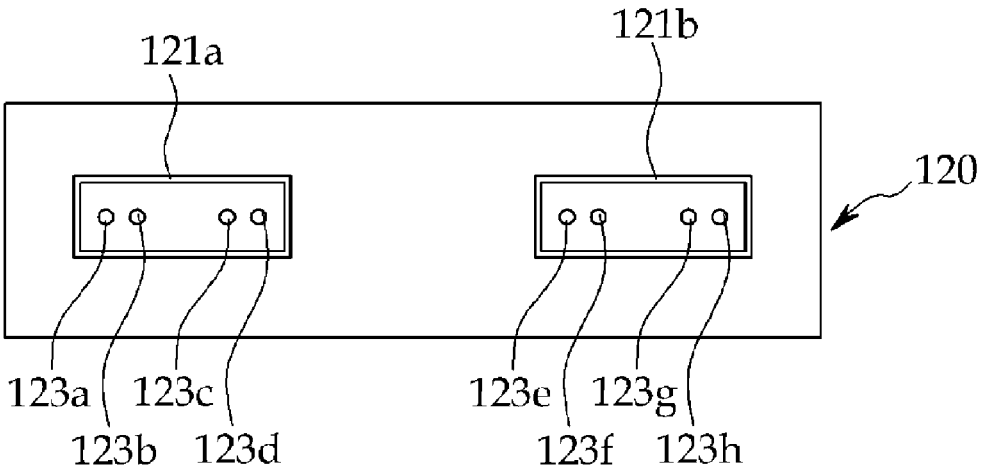
FIGS. 21*a* and 21*b* are plan views of the first connection terminal and the second connection terminal of the lighting device in accordance with the embodiment 2 of the present invention.
Figure 21B:
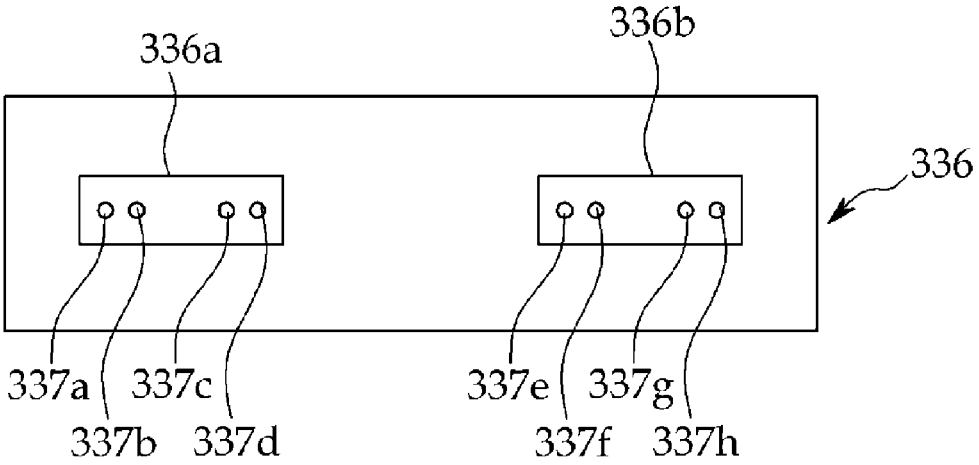

FIG. 20 is a perspective view of a coupling of a first connection terminal 120 and a second connection terminal 336 of the lighting device in accordance with the embodiment 2 of the present invention.

Referring to FIG. 20, the first connection terminal 120 is formed in the first insertion recess 112 of the coupling member 110. The second connection terminal 336 coupled to the first connection terminal 120 is formed on the middle body 330 of the light source unit 300.

The first and the second connection terminals 120 and 336 are coupled to each other by inserting the light source unit 300 into the first insertion recess 112.

The first connection terminal 120 includes a first female block 121*a* and a second female block 121*b* and without being limited to this, the first connection terminal 120 can include at least one pair of the female blocks. For example, the first female block 121*a* includes a pair of a first terminal 123*a* and a second terminal 123*b* and another pair of a third terminal 123*c* and a fourth terminal 123*d*. The second female block 121*b* includes a pair of a fifth terminal 123*e* and a sixth terminal 123*f* and another pair of a seventh terminal 123*g* and an eighth terminal 123*h*.

The first female block 121*a* and the second female block 121*b* are symmetrical to each other. That is, the first to the fourth terminals 123*a* to 123*d* and the fifth to the eighth terminals 123*e* to 123*h* are symmetrical with respect to a line between the first female block 121*a* and the second female block 121*b*.

The second connection terminal 336 includes a first male block 336*a* and a second male block 336*b* and without being limited to this, the first connection terminal 120 can include at least one pair of the male blocks.

For example, the first male block 336*a* includes a pair of a first socket 336*a* and a second socket 336*b* and another pair of a third socket 337*c* and a fourth socket 337*d*. The second male block 336*b* includes a pair of a fifth socket 337*e* and a sixth socket 337*f* and another pair of a seventh socket 337*g* and an eighth socket 337*h*.

The first male block 336*a* and the second male block 336*b* are symmetrical to each other. That is, the first to the fourth sockets 3373*a* to 337*d* and the fifth to the eighth sockets 337*e* to 337*h* are symmetrical with respect to a line between the first male block 336*a* and the second male block 336*b*.

A polarity of the first female block 121*a* and a polarity of the second female block 121*b* may be symmetrical to each other.

The polarities of the first and the second terminals 123*a* and 123*b* are symmetrical to the polarities of the seventh and the eighth terminals 123*g* and 123*h*. For example, if the polarities of the first and the second terminals 123*a* and 123*b* are '+' and '−' respectively, the polarities of the seventh and the eighth terminals 123*g* and 123*h* are '−' and '+' respectively. If the polarities of the first and the second terminals 123*a* and 123*b* are '−' and '+' respectively, the polarities of the seventh and the eighth terminals 123*g* and 123*h* are '+' and '−' respectively.

Additionally, the polarities of the third and the fourth terminals 123*c* and 123*d* are symmetrical to the polarities of the fifth and the sixth terminals 123*e* and 123*f*. For example, if the polarities of the third and the fourth terminals 123*c* and 123*d* are '+' and '−' respectively, the polarities of the fifth and the sixth terminals 123*e* and 123*f* are '−' and '+' respectively. If the polarities of the third and the fourth terminals 123*c* and 123*d* are '−' and '+' respectively, the polarities of the fifth and the sixth terminals 123*e* and 123*f* are '+' and '−' respectively.

The polarities of the first to the eighth sockets 337*a* to 337*h* can be various formed depending on the polarities of the first to the eighth terminals 123*a* to 123*h*.

When the light source unit 300 is coupled to the coupling member 110 in the first direction, the first connection terminal 120 is electrically and physically connected to the second connection terminal 336 by inserting the first and the second terminals 123*a* and 123*b* into the first and the second sockets 337*a* and 337*b*, inserting the third and the fourth terminals 123*c* and 123*d* into the third and the fourth sockets 337*c* and 337*d*, inserting the fifth and the sixth terminals 123*e* and 123*f* into the fifth and the sixth sockets 337*e* and 337*f*, inserting the seventh and the eighth terminals 123*g* and 123*h* into the seventh and the eighth sockets 337*g* and 337*h*.

In addition, when the light source unit 300 is coupled to the coupling member 110 in a second direction (that is, a reverse direction to the first direction), the first connection terminal 120 is electrically and physically connected to the second connection terminal 336 by inserting the first and the second terminals 123*a* and 123*b* into the seventh and the eighth sockets 337*g* and 337*h*, inserting the third and the fourth terminals 123*c* and 123*d* into the fifth and the sixth sockets 337*e* and 337*f*, inserting the fifth and the sixth terminals 123*e* and 123*f* into the third and the fourth sockets 337*c* and 337*d*, inserting the seventh and the eighth terminals 123*g* and 123*h* into the first and the second sockets 337*a* and 337*b*.

As such, since the structures and polarities of the first connection terminal 120 and the second connection terminal 336 are symmetrical to each other, it is possible to connect the light source unit 300 to the coupling member 110 irrespective of the coupling direction. Accordingly, the lighting device according to the embodiment 2 makes it easier to couple the light source unit 300 to the coupling member 110, enhancing a convenience for use thereof.

In the meantime, when the light source unit 300 is coupled to the coupling member 110, the first, second, seventh and eighth terminals 123*a*, 123*b*, 123*g* and 123*h* are used as connectors for transferring electric power. The third, fourth, fifth and sixth terminals 123*c*, 123*d*, 123*e* and 123*f* are used or not used as connectors for transferring a driving signal.

On the contrary, the third, fourth, fifth and sixth terminals 123*c*, 123*d*, 123*e* and 123*f* can be used as connectors for transferring electric power. The first, second, seventh and eighth terminals 123*a*, 123*b*, 123*g* and 123*h* can be used or not used as connectors for transferring a driving signal.

6) Limit Switch 337

A limit switch 337 is provided on both sides of the middle body 330. The limit switch 337 is in an on-state or in an off-state as the first body 310 and the second body 320 move toward the middle body 330. The limit switch is hereby configured in such a manner as to connect or disconnect the electric power supplied to the light emitting diode module. The detailed description of the limit switch 337 will be described later.

5. Coupling and Separation of Light Source Unit 300 and Coupling Member 110

Figure 22:
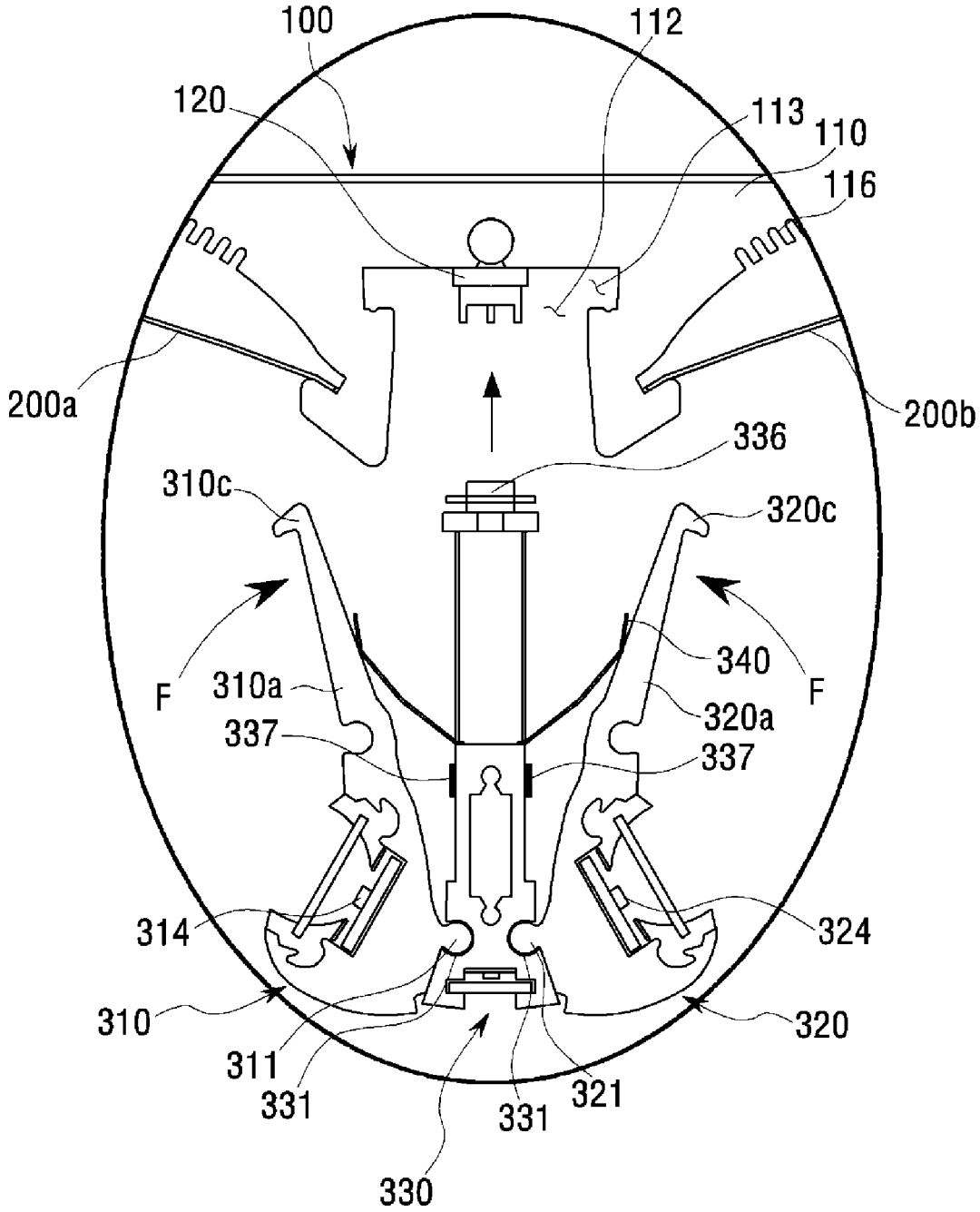
FIGS. 22 and 23 show a coupling and separation process of the light source unit and the coupling member in accordance with the embodiment 2 of the present invention.
Figure 23:
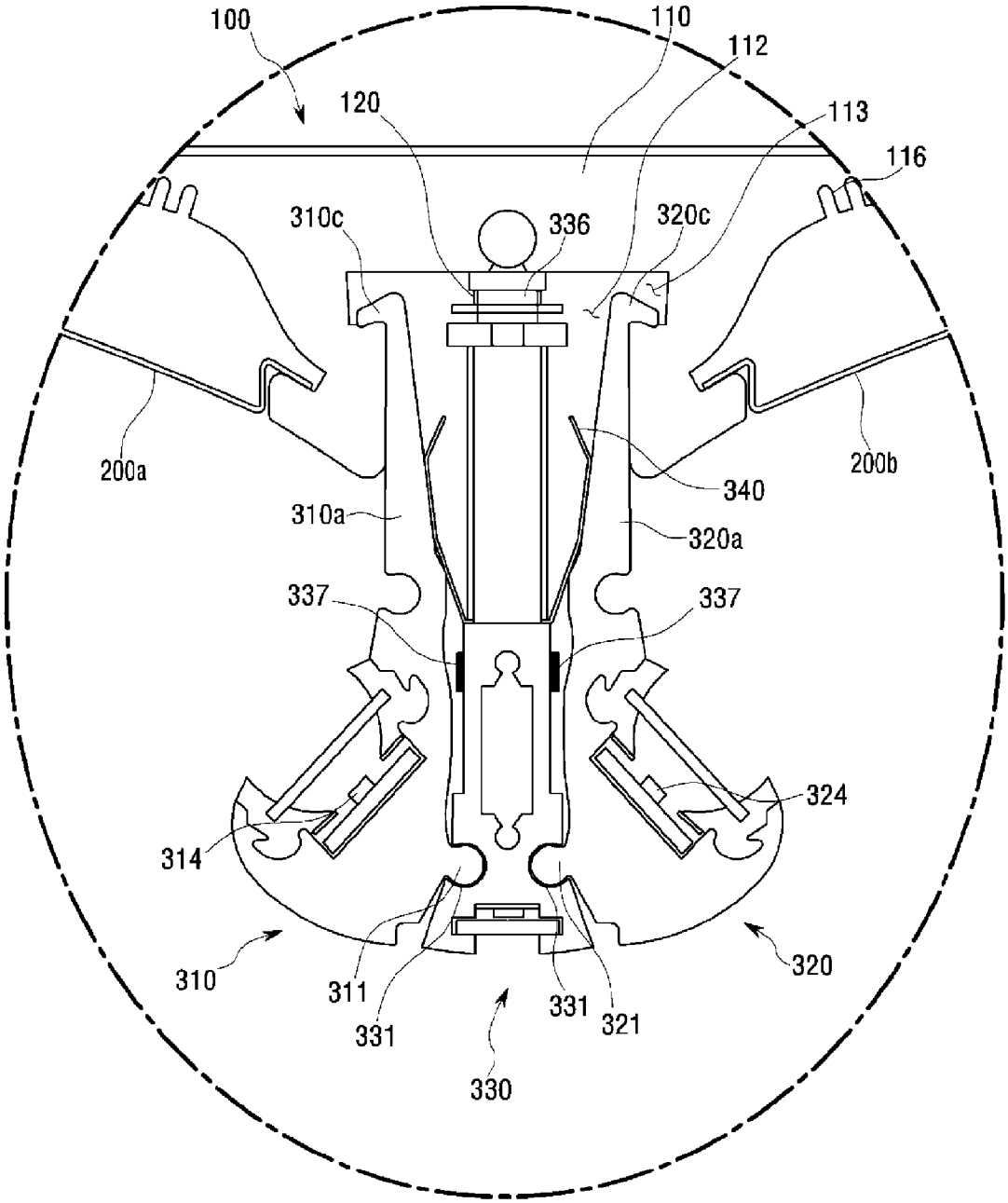

FIGS. 22 and 23 show a coupling and separation process of a light source unit 300 and a coupling member 110 in accordance with an embodiment 2 of the present invention.

Coupling Process

First, as shown in FIG. 22, an angle between the first body 310 and the second body 320 is reduced by applying a first force F to the first body 310 and the second body 320 of the light source unit 300. Here, the direction of the first force F is reverse to the direction of the elastic force applied by the spring 340. When the lower parts of the first and the second coupling units 310*a* and 320*a* are pressed by applying the first force F, a space between the first and the second coupling units 310*a* and 320*a* is reduced, so that an angle between the first body 310 and the second body 320 is reduced.

If the first force F is not applied, a space between the first body 310 and the second body 320 is widened by the elastic force applied by the spring 340, so that it is difficult to insert the light source unit 300 into the first insertion recess 112 of the coupling member 110.

Next, as the first force F is applied to the first and the second bodies 310 and 320, the light source unit 300 is inserted into the first insertion recess 112 of the coupling member 110.

As shown in FIG. 23, if the first force F is not applied, a space between the first and the second bodies 310 and 320 is widened again, so that the projection is inserted into the third recess 113 formed on the inner surface of the first insertion recess 112. As a result, the light source unit 300 can be coupled to the coupling member 110.

When the light source unit 300 is inserted into the coupling member 110, the spring 340 disposed between the first body 310 and the second body 320 pushes the first body 310 and the second body 320, causing the projections to be more securely coupled to the third recess 113.

The spring 340 gives continuously a uniform pressure to a contact surface formed by causing the first coupling unit 310*a* and the second coupling unit 320*a* to be contact with the first insertion recess 112. Therefore, heat generated from the light source unit 300 can be more efficiently transferred through the contact surface mentioned above.

2) Separation Process

When the light source unit 300 is required to repair, the light source unit 300 can be separated from the coupling member 110.

In separating the light source unit 300 from the coupling member 110, after the angle between the first body 310 and the second body 320 is reduced by applying the first force F to the first body 310 and the second body 320, the light source unit 300 is separated from the coupling member 110.

6. An Example of Limit Switch

Figure 24A:
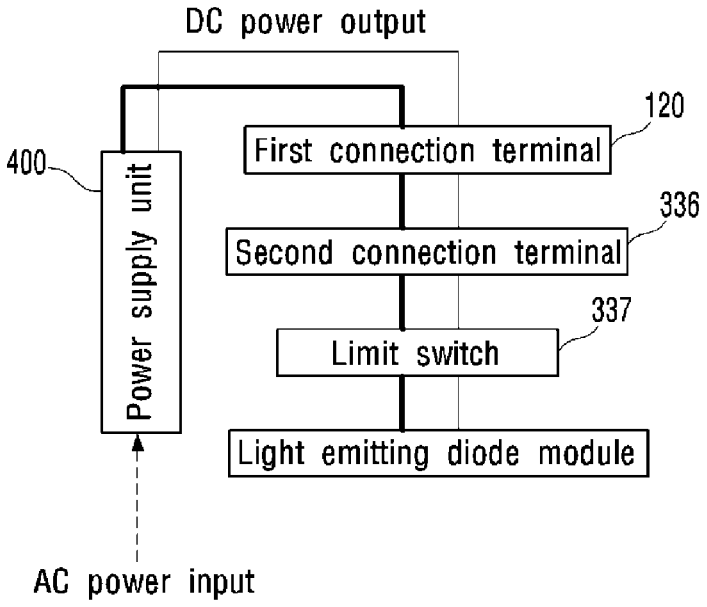
FIGS. 24*a* and 24*b* show how a limit switch in accordance with the embodiment 2 is operated.
Figure 24B:
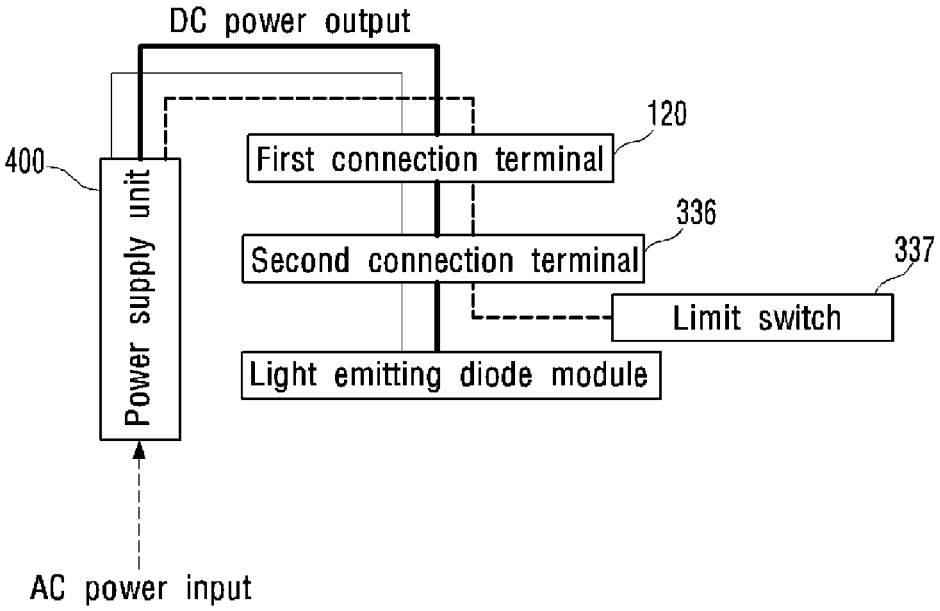

FIG. 24*a* shows how a mechanical limit switch according to an embodiment 2 is operated. FIG. 24*b* shows how a sensor type limit switch according to an embodiment 2 is operated.

The limit switch according to the embodiment 2 is able to employ a mechanical limit switch or a sensor type limit switch.

Mechanical Limit Switch

When the first force F is applied to the first and the second bodies 310 and 320, the first and the second bodies 310 and 320 rotate in the direction of the middle body 330, so that the inner surfaces of the first and the second bodies 310 and 320 approach close to both sides of the middle body 330 respectively. When the first and the second bodies 310 and 320 approach close to both sides of the middle body 330 to a certain extent respectively, the limit switch 337 contacts with the first and the second bodies 310 and 320. Here, the limit switch 337 disposed on both sides of the middle body 330 is pressed through the use of button by the first and the second bodies 310 and 320 and becomes in an off-state. In this case, the limit switch 337 is capable of electrically separating the second connection terminal 336 from the light emitting diode module.

Next, after the light source unit 300 is completely coupled to the coupling member 110, a distance between the first body 310 and the second body 320 is increased. As a result, the limit switch 337 becomes in an on-state, so that the second connection terminal 336 may be electrically connected again to the light emitting diode module.

2) Sensor Type Switch

When the first force F is applied to the first and the second bodies 310 and 320, the first and the second bodies 310 and 320 rotate in the direction of the middle body 330, so that the inner surfaces of the first and the second bodies 310 and 320 approach close to both sides of the middle body 330 respectively. Here, the limit switch 337 disposed on both sides of the middle body 330 detects the motions of the first and the second bodies 310 and 320.

There are two kinds of the aforementioned detecting method. One is a method using the intensity of pressure applied by the first and the second bodies 310 and 320 and the other is a method using a magnetic field intensity measured from the first and the second bodies 310 and 320.

The limit switch 337 using the intensity of pressure may include a pressure sensor. Such a limit switch 337 measures the intensity of pressure applied by the first and the second bodies 310 and 320. If the measured intensity of pressure is greater than a predetermined intensity of pressure, the limit switch 337 becomes in an off-state. Here, the limit switch 337 recognizes that the light source is replaced and may generate a control signal for disconnecting the electric power supplied to the light source 300.

Subsequently, when the first connection terminal 120 is connected to the second connection terminal 336, the control signal generated by the limit switch 337, as shown in FIG. 141*b*, may be output to the power supply unit 400 through the first connection terminal 120 and the second connection terminal 336. As a result, the power supply unit 400 is hereby able to disconnect the electric power output based on the control signal.

After the light source 300 is completely coupled to the coupling member 110, as the first force F is decreased, a distance between the limit switch 337 and both the first and the second bodies 310 and 320 is increased. Since the first and the second bodies 310 and 320 are further from the limit switch 337, the intensity of pressure applied by the first and the second bodies 310 and 320 becomes lower than a predetermined intensity of pressure. In this case, the limit switch 337 becomes in an on-state, the control signal is not output. In such a case, the second connection terminal 336 may be electrically connected again to the light emitting diode module.

The limit switch 337 using the magnetic field intensity may include a magnetic sensor. The limit switch 337 using the magnetic field intensity has the same electrical operation method as that of the limit switch 337 using the pressure sensor. However, in case of the limit switch 337 using the magnetic sensor, a magnet is provided on the inner surfaces of the first and the second bodies 310 and 320. The position of the magnet corresponds to the position of the magnetic sensor. Accordingly, it is possible to measure the magnetic field intensity according to a distance between the middle body 330 and the first and the second bodies 310 and 320.

The limit switch 337 using the magnetic sensor is able to recognize the existence, approach and location of an object through a non contact method. The limit switch 337 using the non contact method may be produced by using various proximity sensors as well as the aforementioned magnetic sensor.

Meanwhile, the middle body 330 may include a separate power supply for starting and operating the limit switch 337.

According to the embodiment 2, when the light source unit 300 is required to be disposed or replaced for maintenance, it is possible to safely attach or remove the light source unit 300 by using the limit switch 337 even though the lighting device is in a live status.

Modified Embodiment

Figure 25:
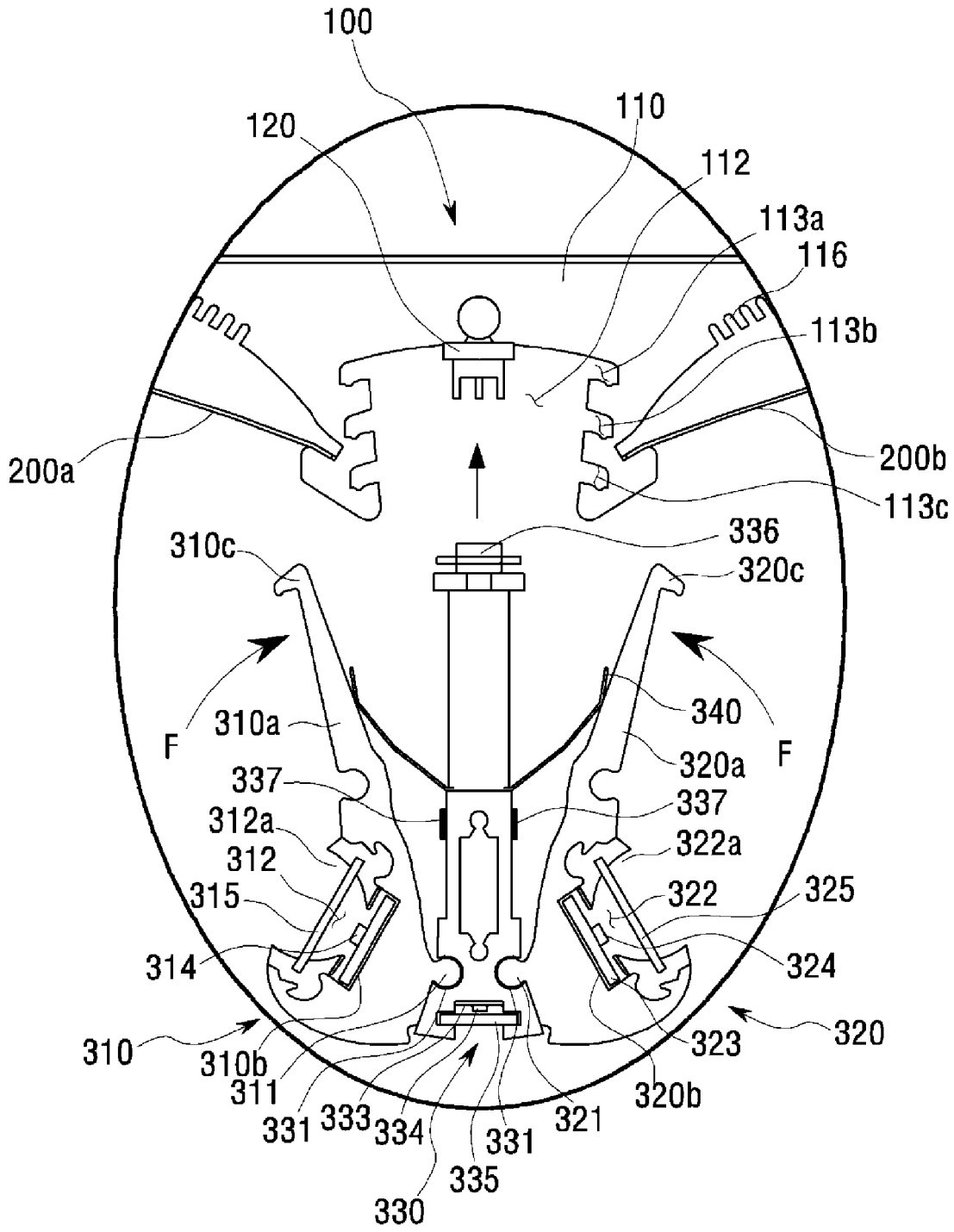
FIGS. 25 and 26 are cross sectional views showing the lighting device in accordance with a modified embodiment 2.
Figure 26:
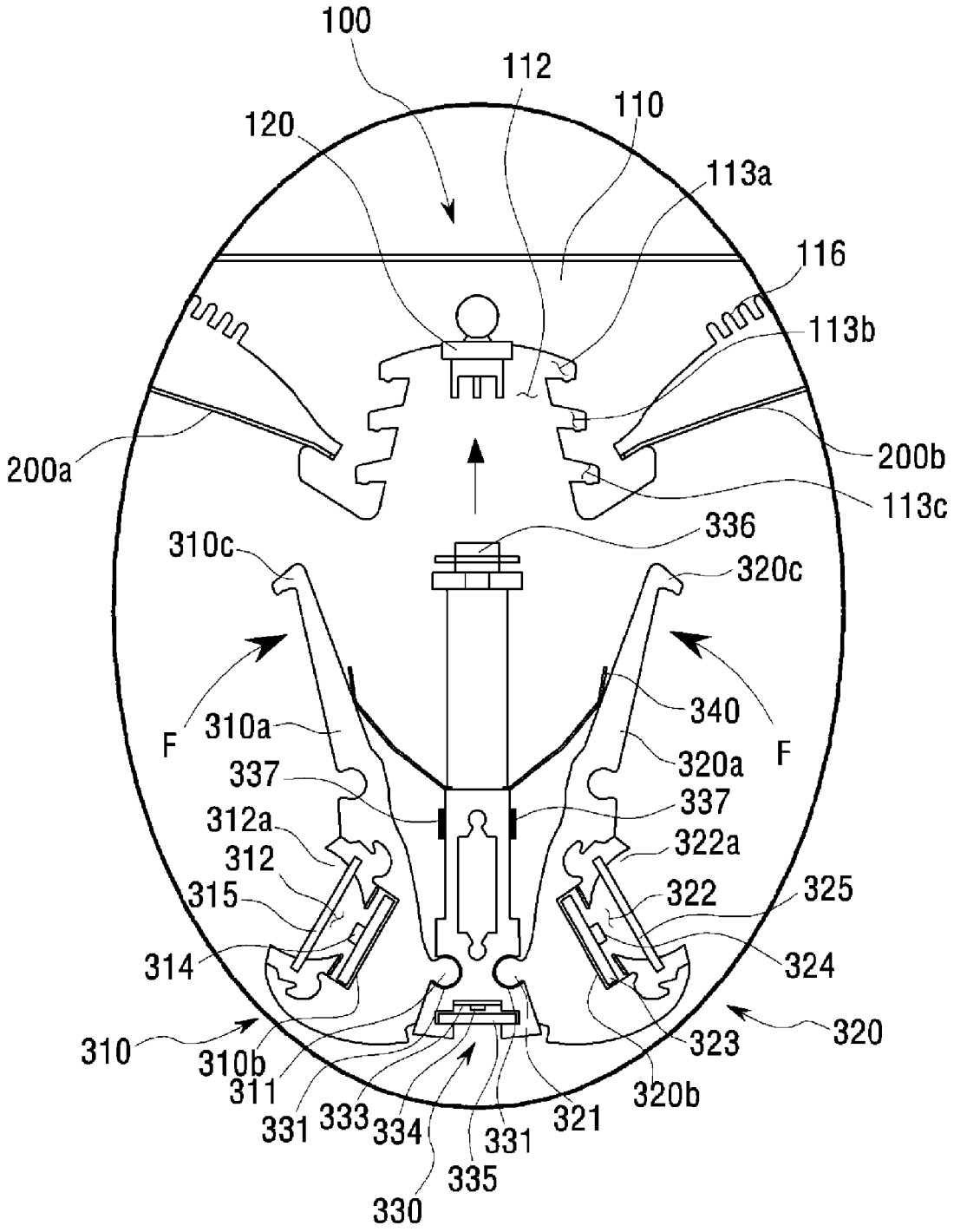

FIGS. 25 and 26 are cross sectional views of a light source unit 300 and a coupling member 110 of a lighting device in accordance with a modified embodiment of the present invention. In description of the lighting device according to a modified embodiment, repetitive descriptions thereof will be omitted.

Referring to FIGS. 25 and 26, the plurality of the third recesses 113*a*, 113*b* and 113*c* are formed on the inner surface of the first insertion recess 112 of the coupling member 110 of the lighting device. While the three third recesses 113*a*, 113*b* and 113*c* are shown, there is no limit to the number of the third recesses.

The light source unit 300 is inserted into and coupled to the first insertion recess 112. Here, the projection of the upper part of the light source unit 300 is inserted into one of the plurality of the third recesses 113*a*, 113*b* and 113*c*, so that the light source unit 300 is strongly coupled to the coupling member 110.

As shown in FIG. 142, depths of the plurality of the third recesses 113*a*, 113*b* and 113*c* are different from each other, it is possible to diversely adjust the light distribution of the lighting device in accordance with one of the plurality of the third recesses 113*a*, 113*b* and 113*c* into which the projection of the light source unit 300 is inserted.

As shown in FIG. 143, the first insertion recess 112 has a sloping inner surface. When a plurality of the third recesses 113*a*, 113*b* and 113*c* are formed on the sloping inner surface of the first insertion recess 112, an angle between the first body 310 and the second body 320 of the light source unit 300 varies in accordance with one of a plurality of the third recesses 113*a*, 113*b* and 113*c* into which the projection of the light source unit 300 is inserted. Therefore, it is possible to diversely adjust the light distribution of the lighting device.

As described above, it is possible to diversely adjust the light distribution of the lighting device by forming a plurality of the third recesses 113*a*, 113*b* and 113*c* on the inner surface of the first insertion recess 112. As a result, even though a width or curvature of the reflector 200 changes, it is possible to provide an efficient lighting without changing the light source unit 300.

As described above, it will be appreciated by those skilled in the art that the present invention may be embodied in other specific forms without departing from its spirit or essential characteristics.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A lighting device comprising:

a housing;

a coupling member coupled to the housing, comprising a first outer surface and a second outer surface, and having an insertion groove disposed between the first outer surface and the second outer surface;

a first reflector disposed between the first outer surface of the coupling member and the housing;

a second reflector disposed between the second outer surface of the coupling member and the housing; and a light source unit comprising a first body and a second body, wherein the first body comprises a first coupling unit coupled to a first inner surface of the insertion groove, a first substrate, and a first light emitting device disposed on the first substrate and emitting light to the first reflector, wherein the first body has a first cavity in which the first substrate and the first light emitting device are disposed, wherein the second body comprises a second coupling unit coupled to a second inner surface of the insertion groove, a second substrate, and a second light emitting device disposed on the second substrate and emitting lights to the second reflector, and wherein the second body has a second cavity in which the second substrate and the second light emitting device are disposed.

2. The lighting device of claim 1, wherein the first coupling unit of the first body includes one surface, wherein the one surface contacts with the first inner surface of the insertion groove, and wherein the first body and the coupling member are made of a metallic material having a high thermal conductivity.

3. The lighting device of claim 1, wherein the first coupling unit of the first body includes a projection, wherein the first inner surface of the insertion groove has a groove, and wherein the projection is inserted into the groove.

4. The lighting device of claim 1, wherein the first coupling unit of the first body includes a projection, wherein the first inner surface of the insertion groove has a plurality of grooves, and wherein the projection is inserted into one of the plurality of grooves.

5. The lighting device of claim 4, wherein depths of the plurality of grooves are different from each other.

6. The lighting device of claim 4, wherein the first inner surface of the insertion groove is a sloped surface.

7. The lighting device of claim 1, wherein the light source unit further comprises a middle body disposed between the first body and the second body.

8. A lighting device comprising:

a housing;

a coupling member coupled to the housing, comprising a first outer surface and a second outer surface, and having an insertion recess disposed between the first outer surface and the second outer surface;

a first reflector disposed between the first outer surface of the coupling member and the housing;

a second reflector disposed between the second outer surface of the coupling member and the housing; and a light source unit comprising a first body and a second body, wherein the first body comprises a first coupling unit coupled to a first inner surface of the insertion recess and a first light emitting device emitting light to the first reflector, wherein the second body comprises a second coupling unit coupled to a second inner surface of the insertion recess and a second light emitting device emitting light to the second reflector, wherein the light source unit comprises a sensor, and wherein the sensor includes at least one of a camera, a photo sensor, a pressure sensor, a temperature sensor, a burglarproof sensor, or an electric wave sensor.

9. The lighting device of claim 8, wherein a luminance and color senses of the light source unit are adjusted by the data sensed by the sensor.

10. A lighting device comprising:

a housing;

a coupling member coupled to the housing, comprising a first outer surface and a second outer surface, and having an insertion recess disposed between the first outer surface and the second outer surface;

a first reflector disposed between the first outer surface of the coupling member and the housing;

a second reflector disposed between the second outer surface of the coupling member and the housing; and a light source unit comprising a first body and a second body, wherein the first body comprises a first coupling unit coupled to a first inner surface of the insertion recess and a first light emitting device emitting light to the first reflector, wherein the second body comprises a second coupling unit coupled to a second inner surface of the insertion recess and a second light emitting device emitting light to the second reflector, and wherein the coupling member includes an uneven structure.

11. A lighting device comprising:

a housing;

a coupling member coupled to the housing and having an insertion groove;

a light source unit comprising:

a first body coupled to the insertion groove of the coupling member;

a second body coupled to the insertion groove of the coupling member; and an elastic member disposed between the first body and the second body and providing a force pushing outward upper portions of the first body and the second body; and a coupling cap coupled to at least of the ends of the first body and the second body, and comprising first and second axis protrusions and first and second deterrent protrusions, wherein the first body is coupled to the first axis protrusion and the first deterrent protrusion, and wherein the second body is coupled to the second axis protrusion and the second deterrent protrusion.

12. The lighting device of claim 11, wherein the first body has a first groove into which the first deterrent protrusion is inserted, wherein the second body has a second groove into which the second deterrent protrusion is inserted, wherein the first groove and the second groove are opened to the outside of the light source unit, and wherein a maximum angle between the first body and the second body is formed by the first deterrent protrusion and the second deterrent protrusion.

13. The lighting device of claim 12, wherein the light source unit further comprises a middle body disposed between the first body and the second body, wherein the middle body has a third groove, and wherein the coupling cap includes a fixing protrusion inserted into the third groove.

14. The lighting device of claim 13, wherein the coupling member includes a first connection terminal disposed in the insertion groove, wherein the middle body includes a second connection terminal disposed on the middle body, and wherein the elastic member disposed on the middle body.

15. A lighting device comprising:

a housing including an upper surface and an inner wall surface;

a coupling member coupled to the upper surface of the housing;

a reflector disposed between the coupling member and the inner wall surface of the housing;

a light source unit coupled to the coupling member and having a light emitting groove in which a light emitting device is disposed, wherein the reflector is disposed over the light emitting groove, wherein the light source unit comprises a projection part disposed around the light emitting groove, wherein the projection part is on a straight line passing through the light emitting device and an end of the housing, and wherein the light emitting groove includes a basal surface and at least two side surfaces, and wherein the basal surface is sloped and faces the reflector.

16. The lighting device of claim 15, wherein a light source unit further comprises:

a substrate which is disposed on the basal surface and the light emitting device is disposed on the substrate; and an optical structure which is disposed on the light emitting device and is disposed between the two side surfaces.

17. The lighting device of claim 16, wherein the optical structure comprises a phosphor luminescent film.

18. The lighting device of claim 15, wherein the light emitting groove includes at least two side surfaces, at least one of the two side surfaces being curved.

19. The lighting device of claim 15, wherein a light distribution angle of light emitted from the light emitting groove is from 90° to 110°.

* * * * *